US008590186B2

(12) United States Patent
Puello

(10) Patent No.: US 8,590,186 B2
(45) Date of Patent: Nov. 26, 2013

(54) ADVERTISING DISPLAY DEVICES AND CONSTITUENT STRUCTURES

(76) Inventor: Fabio Puello, Santo Domingo (DO)

( * ) Notice: Subject to any disclaimer, the term of this patent is extended or adjusted under 35 U.S.C. 154(b) by 484 days.

(21) Appl. No.: 12/734,603

(22) PCT Filed: Oct. 28, 2008

(86) PCT No.: PCT/DO2008/000005

§ 371 (c)(1),
(2), (4) Date: Aug. 6, 2010

(87) PCT Pub. No.: WO2009/062521

PCT Pub. Date: May 22, 2009

(65) Prior Publication Data

US 2012/0137554 A1 Jun. 7, 2012

(30) Foreign Application Priority Data

Nov. 16, 2007 (DO) ..... P2007-0141

(51) Int. Cl.
*G09F 15/00* (2006.01)

(52) U.S. Cl.
USPC ..... 40/606.17; 52/36.1; 52/764; 248/473

(58) Field of Classification Search
USPC ..... 40/607.1, 610, 606.17, 606.01; 160/10; 52/36.1
See application file for complete search history.

(56) References Cited

U.S. PATENT DOCUMENTS

| | | | | |
|---|---|---|---|---|
| 4,559,733 | A * | 12/1985 | Forslund | 40/606.17 |
| 4,914,873 | A * | 4/1990 | Newhouse | 52/36.1 |
| 6,116,326 | A * | 9/2000 | Domina et al. | 160/351 |
| 6,226,931 | B1 * | 5/2001 | Haversat | 52/71 |
| 6,493,995 | B2 * | 12/2002 | McKenzie | 52/36.4 |
| 6,601,349 | B1 * | 8/2003 | Corden | 52/36.5 |
| 2005/0210724 | A1 * | 9/2005 | Grau et al. | 40/606.01 |

* cited by examiner

*Primary Examiner* — Joanne Silbermann
*Assistant Examiner* — Kristina Junge
(74) *Attorney, Agent, or Firm* — Hector M. Reyes Rivera

(57) ABSTRACT

A series of self-standing and portable advertising displays include a hollow base with access to its interior that may be filled out with a solid or liquid material in order to add weight to the displays. By a combination of common elements as lateral supports, connecting unit, lower and upper corners units, advertising support frame and hollow base advertising displays having tower shaped structures of different polygonal sides are easily assembled. The obtained display uses tongue and grooves as well as key-hole mechanisms to fastening and secured different components of the structure.

14 Claims, 27 Drawing Sheets

ADVERTISING DISPLAY DEVICES AND CONSTITUENT STRUCTURES

This application is the National Stage filing under 35 USC 371 of International Application No. PCT/DO2008/000005 filed on Oct. 28, 2008 which claims the benefits of earlier filing date and right of priority to Dominican Republic Application No. P-2007-0141, filed on Nov. 16, 2007. The entire disclosure of the above patent applications are hereby incorporated by reference.

FIELD OF THE INVENTION

The invention relates to advertising displays, and in particular to portable advertising displays of different polygonal structures, thus providing two, three, four and more faces in order to display promotional information in multiple angles.

BACKGROUND OF THE INVENTION

It is widely known that there are multiple ways to project an advertising message. Among these, advertising billboards and towers have been one of the most frequently used over the years, especially when using medium and large advertising formats.

Generally, these advertising billboards and towers comprise a flat structure that supports the advertising device. Publicity is placed only on one flat face such as in billboards, what indicates that people should be placed in front of it to have visual access to the whole displayed message. In some instances, billboards are fitted with a rotation mechanism or electric motor, allowing them to rotate 360 degrees, showing their main faces. However, in such cases, the advertising displays usually have complex and expensive framework which is difficult to assemble, requiring thus expensive and/or difficult to handle tools. Furthermore, is not possible to place an advertisement on the side parts of these billboards.

On the other hand, advertising towers are generally composed by a base, a column or pole fixed to the floor that raises perpendicular to this, and an upper structure of two or more faces, in which advertising is placed. These towers have the disadvantage of being not aesthetically pleasing, their structures are hardly functional and are limited to open spaces or outdoors.

Technologies focused on solving the problems described above are known in the state of the art. Patent ES 1061864U describes and claims an advertising structure, especially to be placed at roundabouts or squares. This device is characterized by having a triangular prism shape defined by vertical tubular elements anchored to the ground, and these elements are related by other perimeter elements. Each side has frames that are part of the structure. Flexible surfaces containing advertising messages are placed on the frames. While this device can display advertising messages on three sides, it is also true that being anchored or fix to the ground is the main difficult because it not only limits its movement capacity but also its possibilities of use. Also, exposing publicity is limited to only the three faces of the structure. Similarly, Patent JP 2000162972 discloses a four-sided advertising tower having fixed to it aluminum frames, from where replaceable panels of canvas are place. In this tower faces are square. It suggests that it is needed a square base in order to fix the faces to the base and form the structure. Thus, the tower requires some fixing pieces somewhere in its structure to be properly fixed the corresponding sections of said display.

In general terms, among the main currently problems in advertising structures are the difficulty of displaying the promotional information in different angles; the display structures are fixed to the ground or a wall; the display unit is limited to one or two areas in which the advertisement is placed; the display structure is limited or restricted by its own nature to specific areas of application due to its own structures and configurations and in most cases, the structures are difficult to assemble and disassemble.

Thus, there is a need of portable, self-supporting advertising displays having one or multiple polygonal structures capable to display promotional or advertising information in multiple angles.

SUMMARY OF THE INVENTION

A main objective of the present invention is to provide different portable advertising displays structures that are easy to assemble or disassemble and may be conveniently use in shopping malls, fairs, airports, ports, parking, entertainment, streets, highways, streets, stadiums, buildings, hotels, among others place.

Another objective of the instant invention is to provide advertising space to make public goods and services indoor or outdoor. In another objective of the present invention is to provide advertising displays or stands that are self-supported and portable thus, do not require to be secured or physically bound to the ground or a wall and may be moved from a given place to another according will of the user. In a still another objective of the invention is to provide advertising devices that require no complicated and expensive fixing devices or anchors in order to adjust or assemble the displays structures.

Another objective of the present invention is to provide an advertising display which is environmentally friendly since it may incorporate ornamental designs that may match with the environment and thus does not damage the visual environment in which it is placed. Still another objective of this invention is to provide a portable structure or advertising displays, which are self-supporting and having excellent balance, stability and wind resistance.

Other objects, advantages and applications of the present invention will become apparent to those to those skilled in the art when the following description of the best mode contemplated for practicing the invention and/or preferred embodiments are read in conjunction with the accompanying drawings.

BRIEF DESCRIPTION OF THE DRAWINGS

Preferred embodiments of the invention are shown in the drawings, wherein:

FIGS. 4A to 4D shows different views of the already assembled hollow base illustrated in FIG. 3, wherein FIG. 4A and FIG. 4B show two side views of said base, FIG. 4C shows a horizontal upper view and FIG. 4D shows a top view of the hollow base.

FIGS. 6A to 6E show different views of the already assembled lower corner unit illustrated in FIG. 5, wherein FIGS. 6A and 6B are left and right side views; FIG. 6C is a top view; FIG. 6D is a front view while FIG. 6E is a back-or rear view of said lower corner unit.

FIGS. 10A to 10D illustrate different views of the already assembled connecting unit illustrated in FIG. 9, wherein FIG. 10A is a perspective view, FIG. 10B is a front side view, FIG. 10C is a horizontal upper view and FIG. 10D is a top view of the connecting unit.

FIGS. 12A to 12E show different views of the already assembled upper corner unit illustrated in FIG. 10, wherein FIG. 12A is a perspective side view, FIG. 12B and FIG. 12E are rear views, FIG. 12D is a front perspective view and FIG. 12C is a top view of said upper corner unit.

FIGS. 14A to 14D show different views of the prototype of the advertising surface unit, wherein FIG. 14A is a front view, FIG. 14B is a perspective diagonal view, FIG. 14C is a side view and FIG. 14D is a top view of said advertising surface unit.

FIGS. 23A to 23C show different side views of said frame while FIG. 23D shows a top view of said frame.

FIGS. 24A to 24C show different side views of said frame while FIG. 24D shows a top view of said frame.

FIGS. 25A to 25C show different side views of said frame while FIG. 25D shows a top view of said frame.

FIGS. 26A to 26C show different side views of said frame while FIG. 26D shows a top view of said frame.

DETAILED DESCRIPTION OF THE INVENTION

Figure 1:
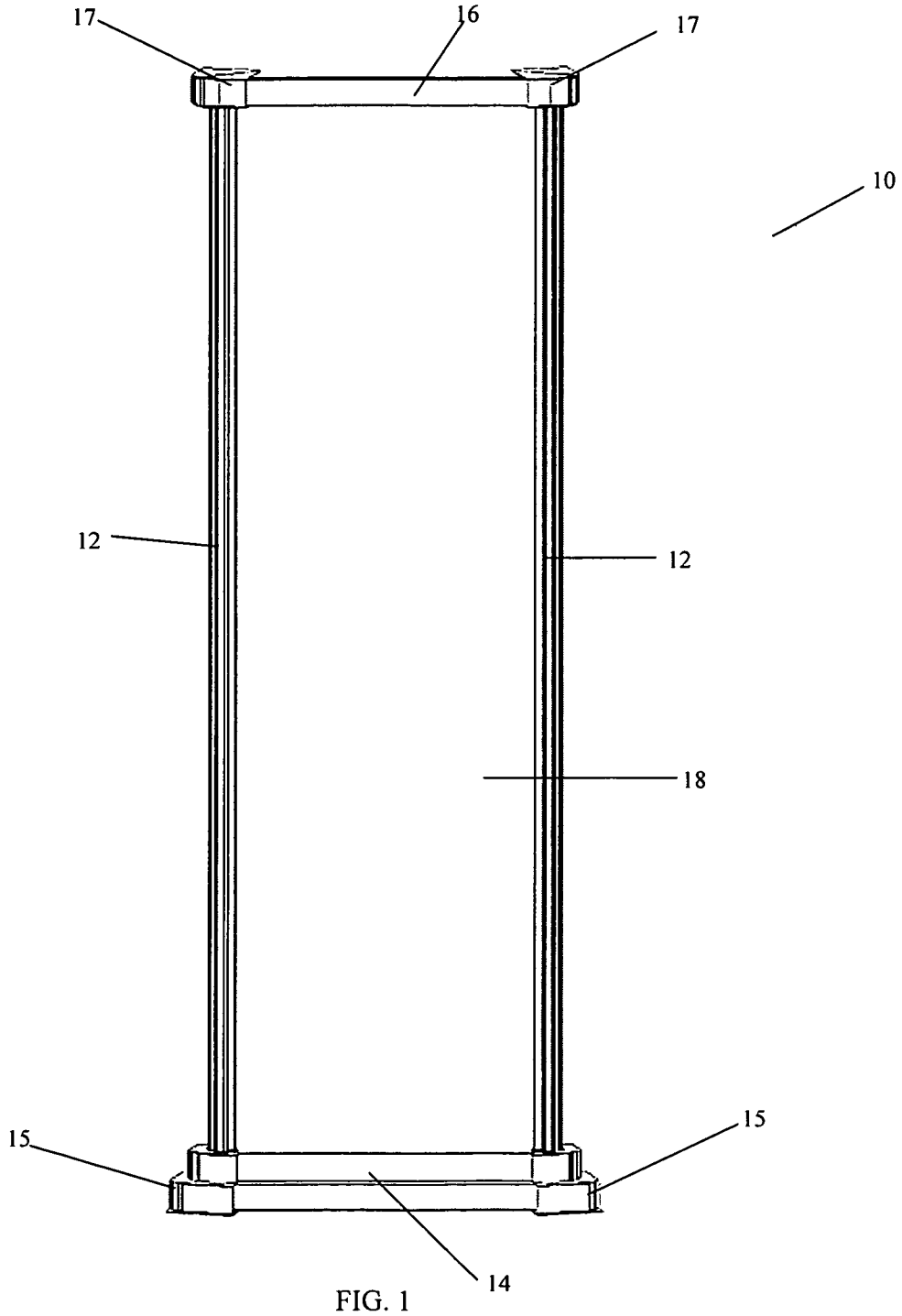
FIG. 1 shows a front view of one of the embodiment of the invention having a flat advertising tower structure.

The present invention will now be described more specifically with reference to the following embodiments. It is to be noted that the following descriptions of preferred embodiments of the instant invention are presented herein for the purpose of illustration and description only; it is not intended to be exhaustive or to be limited to the precise form disclosed. With reference to the figures, like reference characters will be used to indicate like elements throughout the several embodiments and views thereof.

In general terms, the instant invention is directed to portable, self-supporting advertising displays having different polygonal shapes, which are useful in the promotion of goods and services having a series of common elements. Advertising displays according to the instant invention comprises different embodiments having a predetermined polygonal structure. The embodiments are assembled in a predetermined manner and using the same elements in order to increase or decrease the number of faces or sides of a given advertising display and its particular polygonal structure. The advertising displays require a hollow base with access to its interior that may be filled out with a solid or liquid material, said weight provides self-standing and portability to the advertising displays. By a combination of common elements as lateral supports, connecting unit, lower and upper corners units, advertising support frame and hollow base advertising displays having tower shaped structures of different polygonal sides are easily assembled. The obtained advertising display uses tongue and grooves as well as key-hole mechanisms to fastening and secured the structure. External ornamental details may be added to the elements to add versatility in the external appearance of each display.

Figure 2:
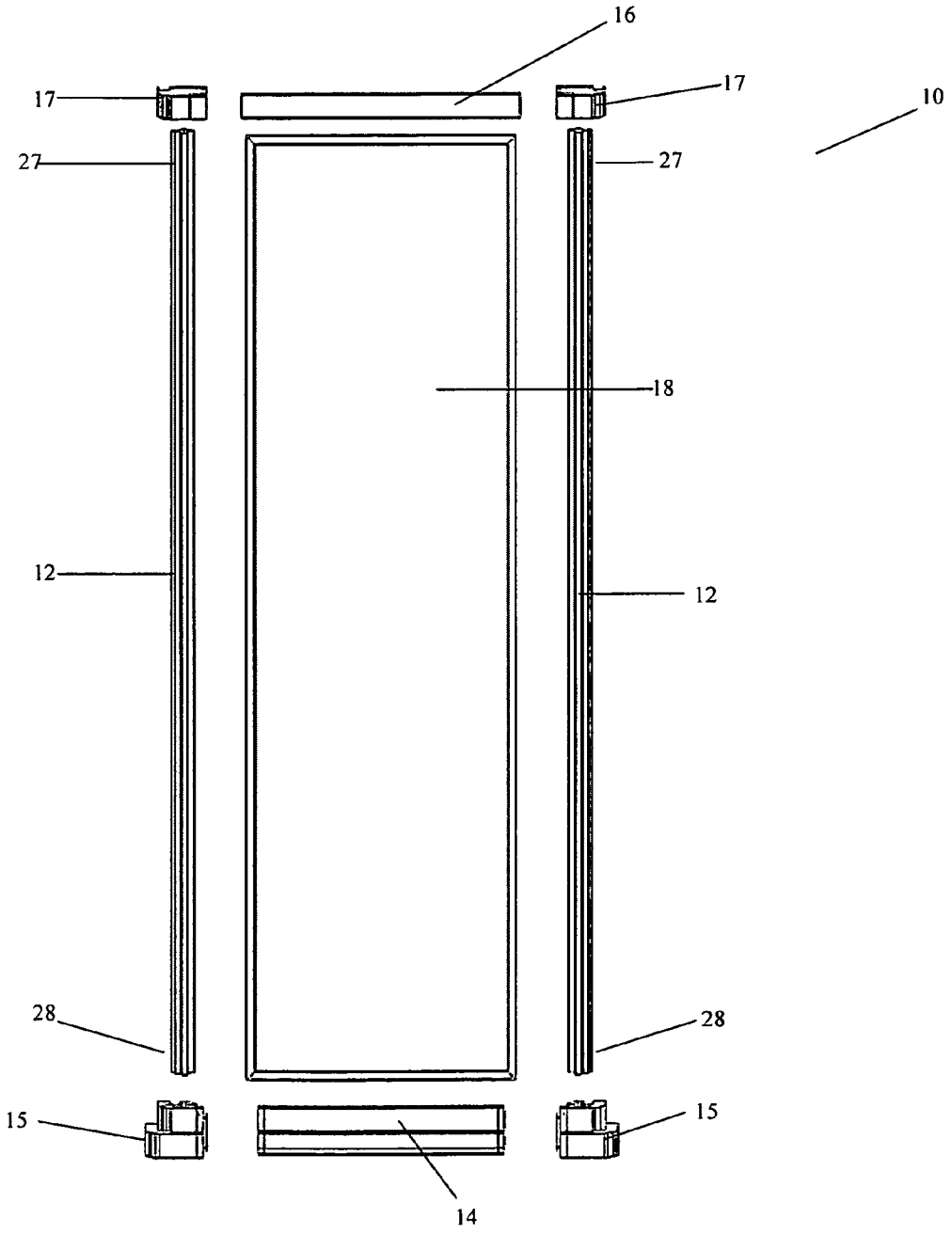
FIG. 2 illustrates an exploded view of the embodiment shown in FIG. 1, showing its components thereof.

FIG. 1 illustrates an embodiment 10 according to of the invention, having a flat rectangular tower shape while FIG. 2 illustrates an exploded view of said embodiment 10, showing all its main components individually and separately. Particularly, embodiment 10 comprises a hollow base 14; an advertising support unit 18, having a rectangular structure dictated by its components; two transversal lateral supports 12; a connecting unit 16; two lower corner units 15 and two upper corner units 17. These particular sections or elements of embodiment 10 are discussed in details below.

Figure 8:
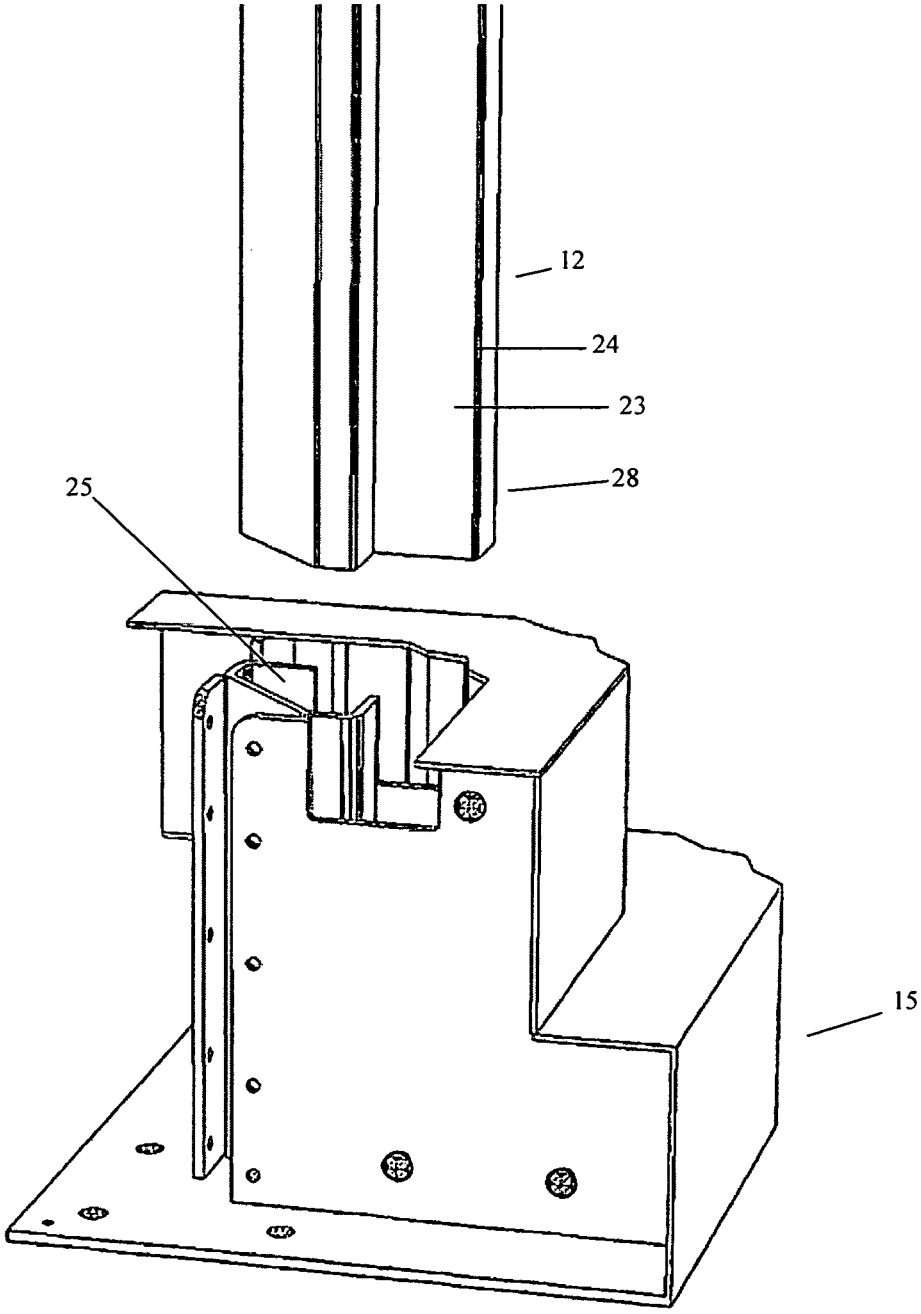
FIG. 8 illustrates the tongue and grooves mechanism used according to the invention to fast the lateral supports with the lower corner units. The same mechanism is used to fast lateral supports with the upper corner units.

Lateral support 12 comprises elongated bodies having at it external surface tongues 21 and grooves 22. Said tongues 21 and grooves 22 are in cooperative matching with tongues 23 and grooves 24 located at the surfaces in internal liners 25 and 26, which are discussed below and illustrated in FIG. 8, in order to properly fast and secure top end 27 and lower end 28 of said lateral supports 12 to the corresponding upper corner unit 17 and to the lower corner unit 15, via said internal liners 25 and 26.

While lateral supports 12 on embodiment 10 are made by a single piece, in other embodiments according to the invention, said lateral supports 12 may be held together, forming a total frame having multiple faces and thus providing a skeleton-type polygonal frame, which may include aesthetic and ornamental details related to the particular polygonal advertising display. Such embodiments according to the instant invention are discussed below.

The main functions of lateral supports 12 are to provide support and security to the advertising display 10 and to join the lower section and the top section of such display, via the groove and tongue mechanism. Furthermore it also has a decorative function as these supports make the advertising device to be in harmony with the environment in which it is placed and being attractive to the eye.

Figure 3:
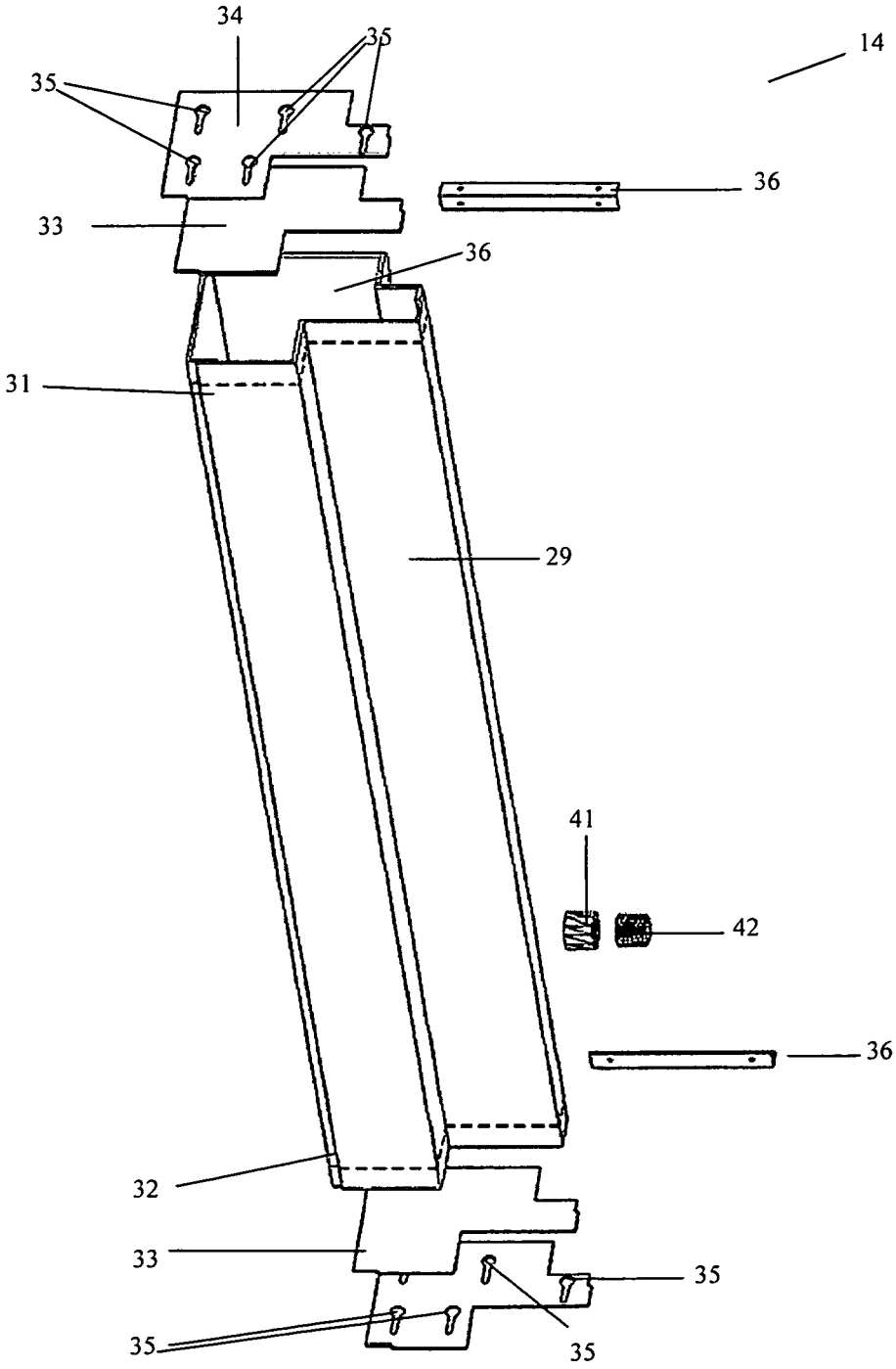
FIG. 3 illustrates a perspective and exploded view of prototype of the hollow base used in the embodiments according to the instant invention showing the various components thereof.
Figure 4A:
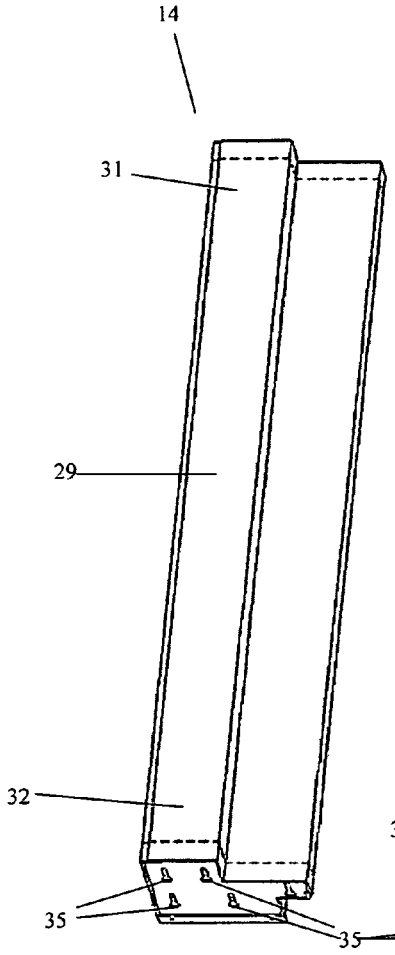
Figure 4B:
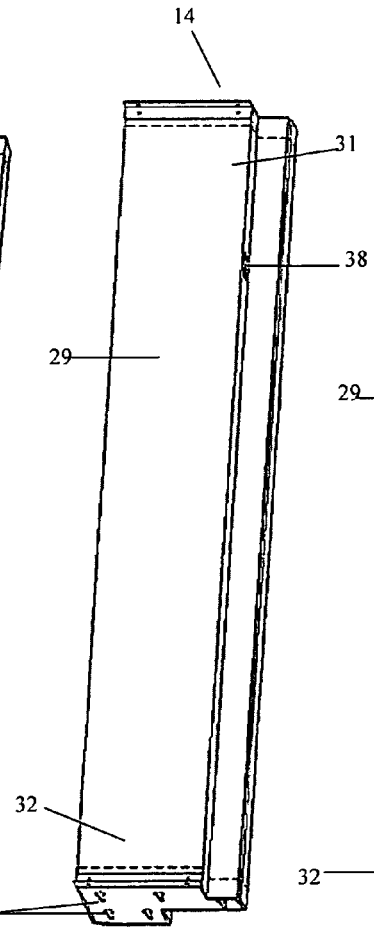
Figure 4C:
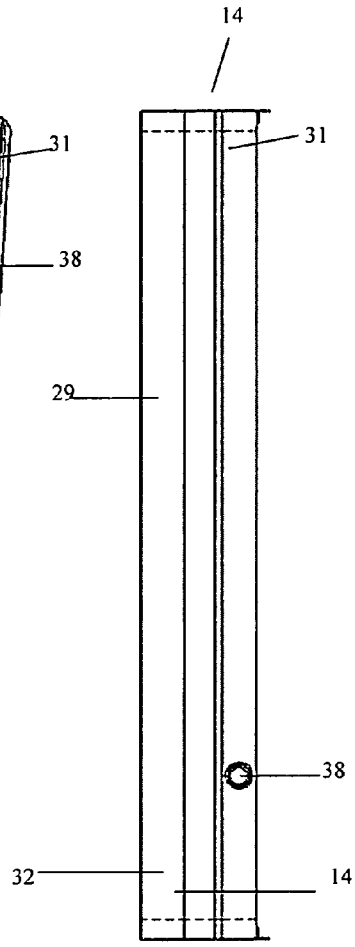
Figure 4D:
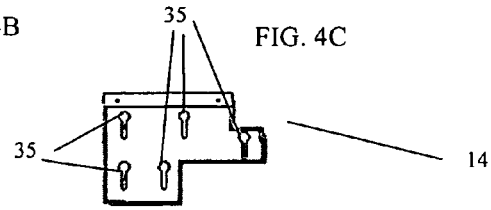

Regarding hollow base 14, its required components are disclosed and illustrated in FIGS. 3 and 4. It comprises a main hollow body 29, preferably of rectangular shape. Said hollow main body 29 comprises a first end 31 and a second end 32. Each one of said ends is permanently sealed with a first cover or seal 33 having a flat and continuous surface. On top of seal 33, a second cover or seal 34, having multiple openings 35 is permanently connected to each one of said ends 31 and 32 of main body 29. Said openings 35 are part of a preferred fastening mechanism of the entire display as explained below. Furthermore, a safety angled holder 36 is permanently attached at the corners of each one of the ends 31 and 32 of main body 29, thus adding more strength and security to the connection of the seals 33 and 34 on each of said ends of main body 29. In this manner, the hollow cavity of 14 becomes a safe internal or inner cavity 37. Main hollow body 29 also comprises an aperture or hole 38, which provides access to the inner cavity 37 and that may be close using threaded liner 41 and threaded stopper 42. The inner cavity 37 serves as a storage, reservoir or container, wherein a heavy material may be safely storage and enclosed. For instance, it may be filled out with a suitable material, such as a suitable liquid such as water or a solid material such as sand, thus providing to the advertising display the stability and portability needed to self-stand and thus eliminating the need of anchoring said display to any given surface. As an alternative, base 14 may be mold as a single piece or it may be assembled as explained previously. The already assembled base 14 is illustrated from different perspectives in FIG. 4.

Figure 5:
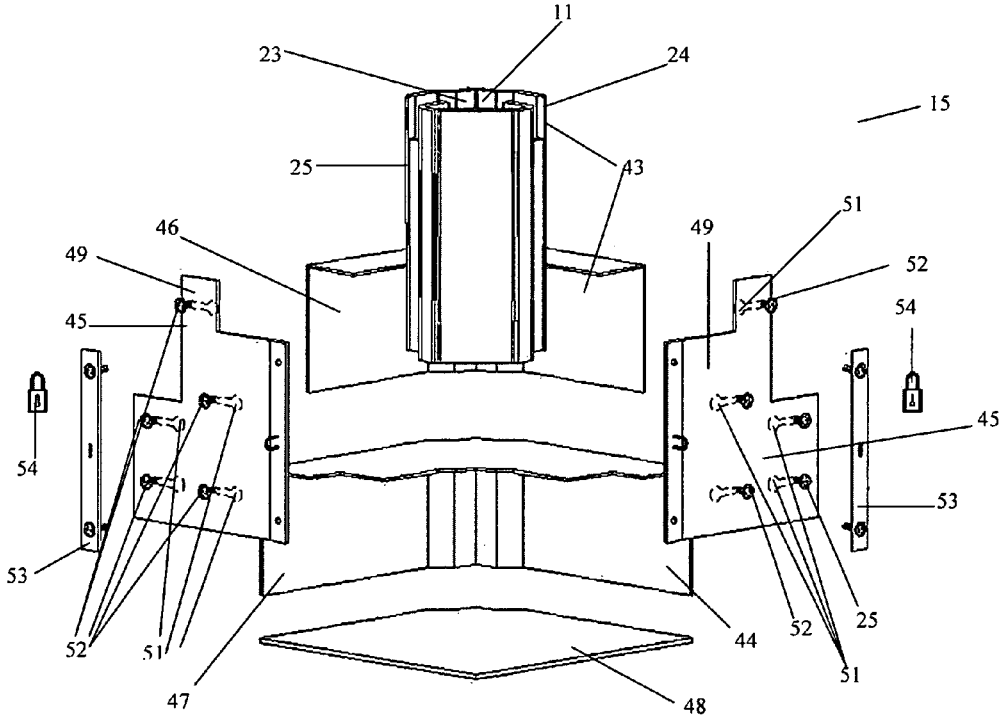
FIG. 5 is an exploded perspective view of a prototype of the lower corner unit, showing its main components thereof. Said lower corner unit is engaged at each end of the hollow base illustrated previously in FIGS. 3 and 4A to 4D.
Figure 6A:
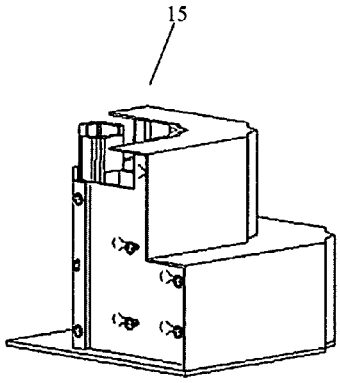
Figure 6B:
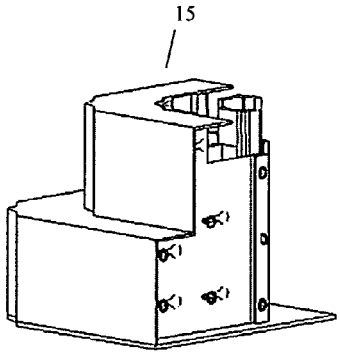
Figure 6C:
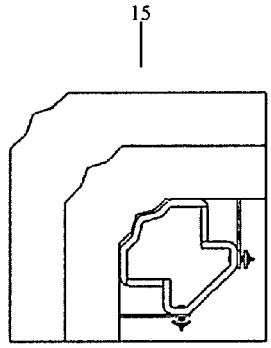
Figure 6D:
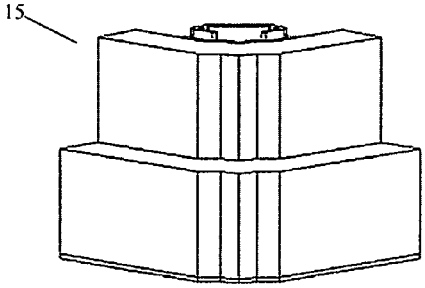
Figure 6E:
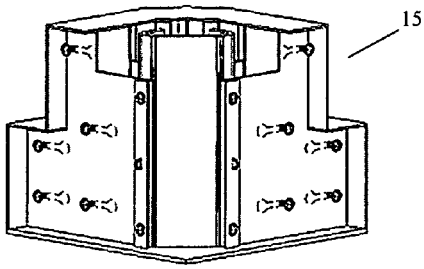

Embodiment 10 also comprises two lower corner units 15, which are fastened to each end 31 and 32 of the hollow main body 29 of base 14. Lower connecting unit 15 may be molded or made as a single piece. Alternatively, it may be assembled from its individual sections or parts. Lower connecting units 15 are essential elements of the advertising displays since its main function is to provide the connections at each one of the ends 31 and 32 of base 14 and at the lower ends 28 of each lateral supports 12. As illustrated in FIGS. 5 and 6, lower corner unit 15 comprises an upper section 43, lower section 44 and lateral sections 45. The upper section 43 comprises a support liner 25, which is hidden inside the interior of said lower corner unit 15 and has an internal cavity 11 and at its surface the tongues 23 and grooves 24. The lower end 28 of the lateral supports 12 may be inserted and fastened at the internal cavity 11, preferably using the tongues and grooves mechanism illustrated in FIG. 8, wherein the tongues 21 and grooves 22 at the surface of lateral support 12 are cooperatively matched with the tongues 23 and grooves 24 at the surface of liner 25.

Figure 7:
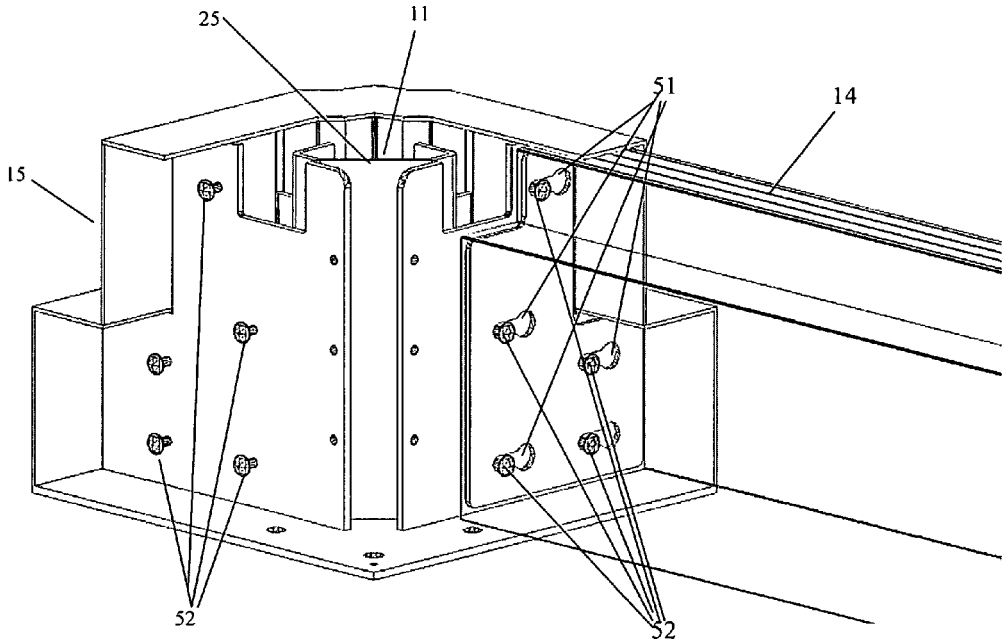
FIG. 7 is an illustration of the key-hole mechanism used as one preferred alternative in fasting hollow base with lower corner unit.

Said lower section 44 also comprises top external side 46, used as a design element exposed to the exterior of the lower corner unit 15. Furthermore, lower section 44 comprises the bottom external side 47 and lower platform 48. The lateral sections 45 comprise a left and a right lateral panel 49, having multiple apertures 51, wherein each aperture has threaded supporting screws 52. Said supporting screws 52 are in cooperatively matching with openings 35, located at each one of the ends 31 and 32 of the main body 29 of hollow base 14 via a key-hole mechanism. The corresponding preferred fastening mechanism or method of base 14 and lower corner units 15 via said key-hole mechanism is illustrated in FIG. 7. Similarly, lateral sections 45 may optionally comprise safety elements 53 and pin padlocks 54, which are useful to further securing the corresponding ends of base 14 to the corresponding lower connecting unit 15. Views of the already assembled lower corner unit from different perspectives are illustrated in FIGS. 6A to 6E.

Figure 9:
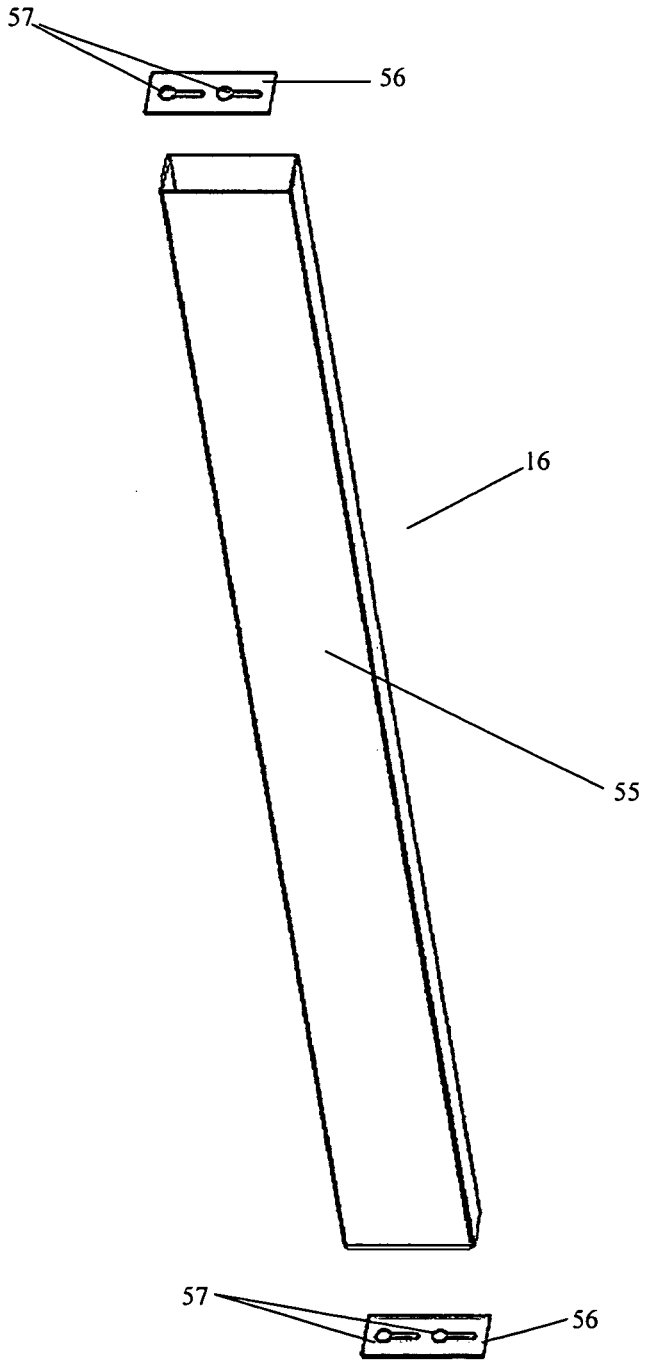
FIG. 9 shows as perspective and exploded view of the connecting unit, showings its main components thereof.
Figure 10A:
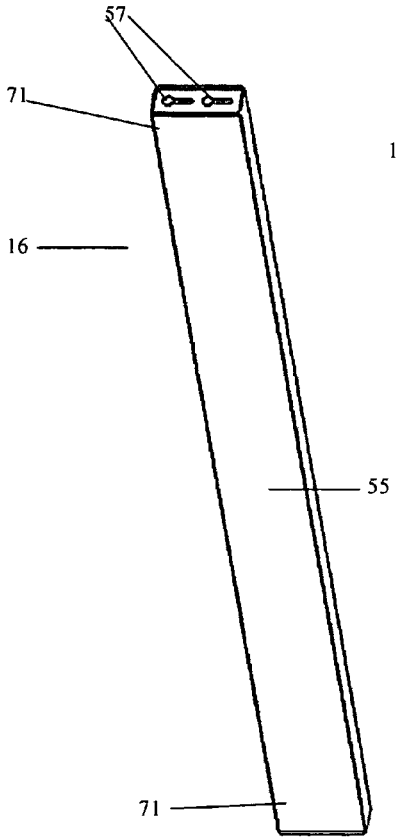
Figure 10D:
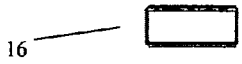
Figure 10B:
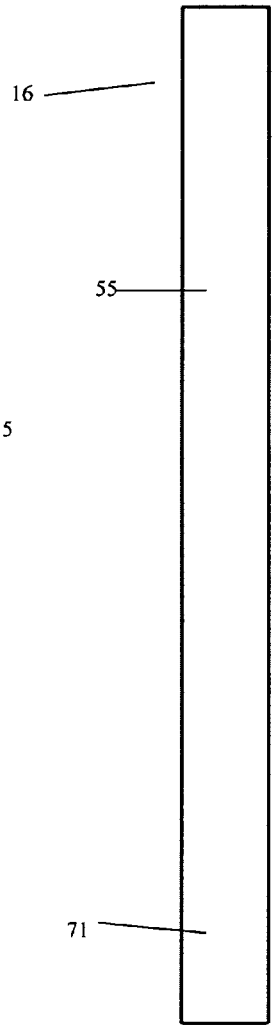
Figure 10C:
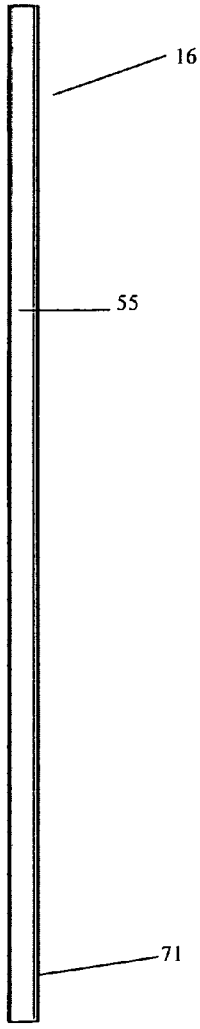

As mentioned previously, embodiment 10 also comprises connecting unit 16, which is illustrated in FIGS. 9 and 10 A to 10D. It comprises a main elongated body 55 having at each one of its ends 71 and 72 a cover 56 with two openings 57. Said openings 57 are in cooperative matching with male-type fastening elements 63 found in the upper corner units 17 via a key-hole mechanism, as explained below. FIGS. 10A to 10D illustrates connecting unit 16 from different views.

Regarding each upper corner units 17, its main functions are fastening and securing lateral supports 12 via preferably of a mechanism of tongues and grooves at its internal section and to horizontally fast and secure the connecting unit 16, preferably by a key-hole mechanism. Upper corner units 17 may be mold or made as a single unit or alternatively it may be assembled by joining different elements.

Figure 11:
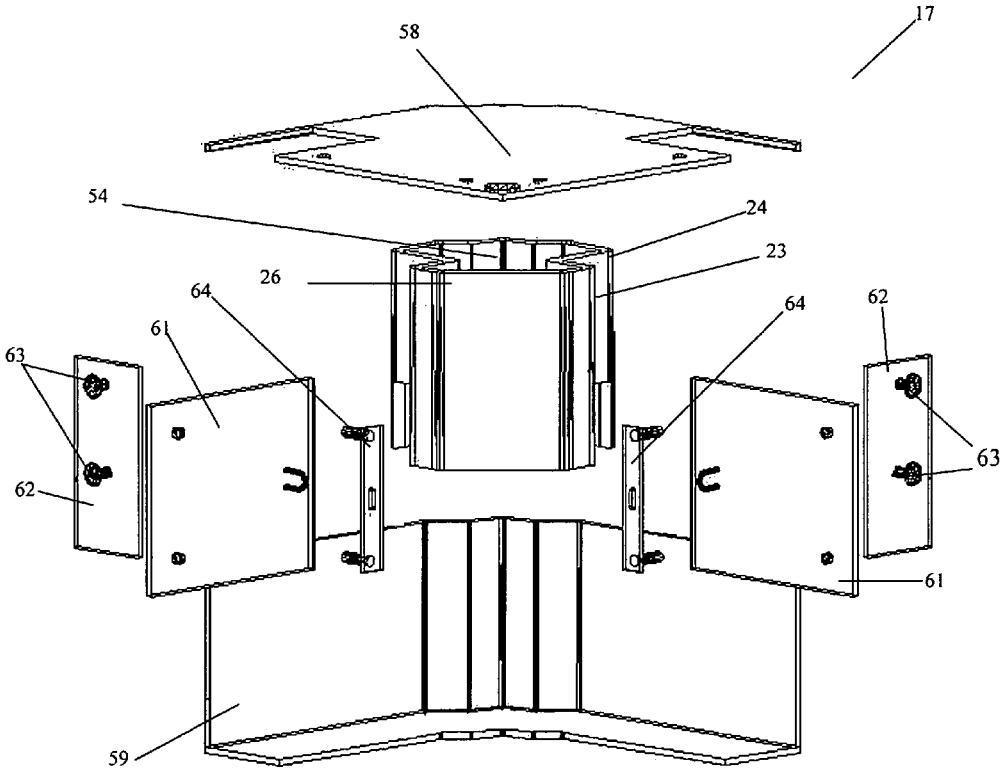
FIG. 11 is an exploded perspective view of a prototype of the upper corner unit, showing its main components thereof. Said upper corner unit is engaged at each end of the connecting unit illustrated previously in FIGS. 9 and 10A to 10D.
Figure 12A:
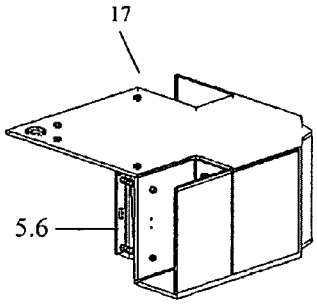
Figure 12B:
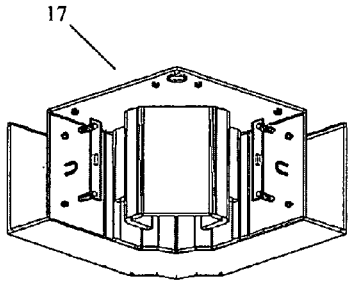
Figure 12C:
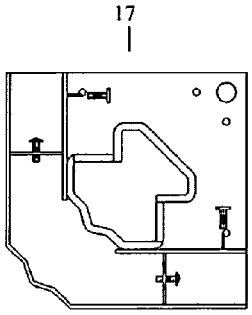
Figure 12D:
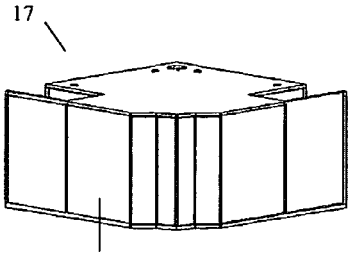
Figure 12E:
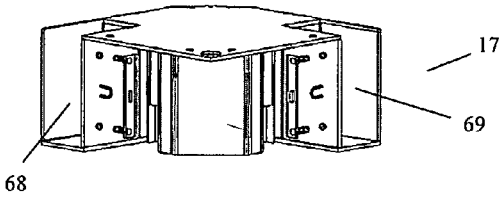

As illustrated in FIG. 11, upper corner unit 17 comprise a upper cover or platform 58, which covers to top of the whole body of upper corner 17 and an external cover section 59, which provides the cover to the internal parts of the upper corner unit 17. It also comprises a support liner 26, which is hidden from the exterior view and comprises an inner cavity 54. It also comprises at its surface multiple tongues 23 and grooves 24 cooperatively matching with the tongues 21 and grooves 22 at the surface of lateral supports 12. Furthermore, it also comprises lateral or side external covers 61 at the left and right sides of the central section of the upper corner unit 17, which are part of the outer body of said upper corner unit 17. The said sections or parts are held together by inner covers 62, having screws 63 and safety latches 64.

Figure 13A:
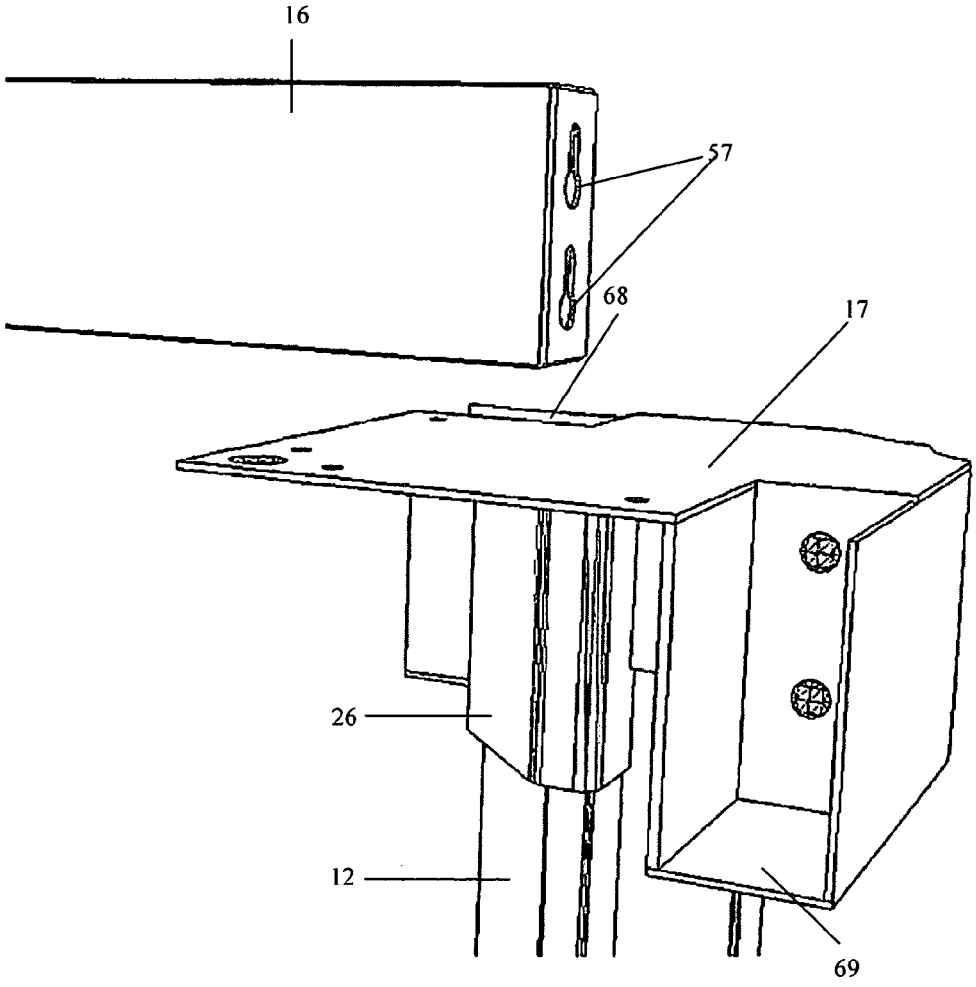
FIGS. 13A and 13B are illustrations of the key-hole mechanism used as one preferred alternative in fasting connecting unit with the upper corner unit.
Figure 13B:
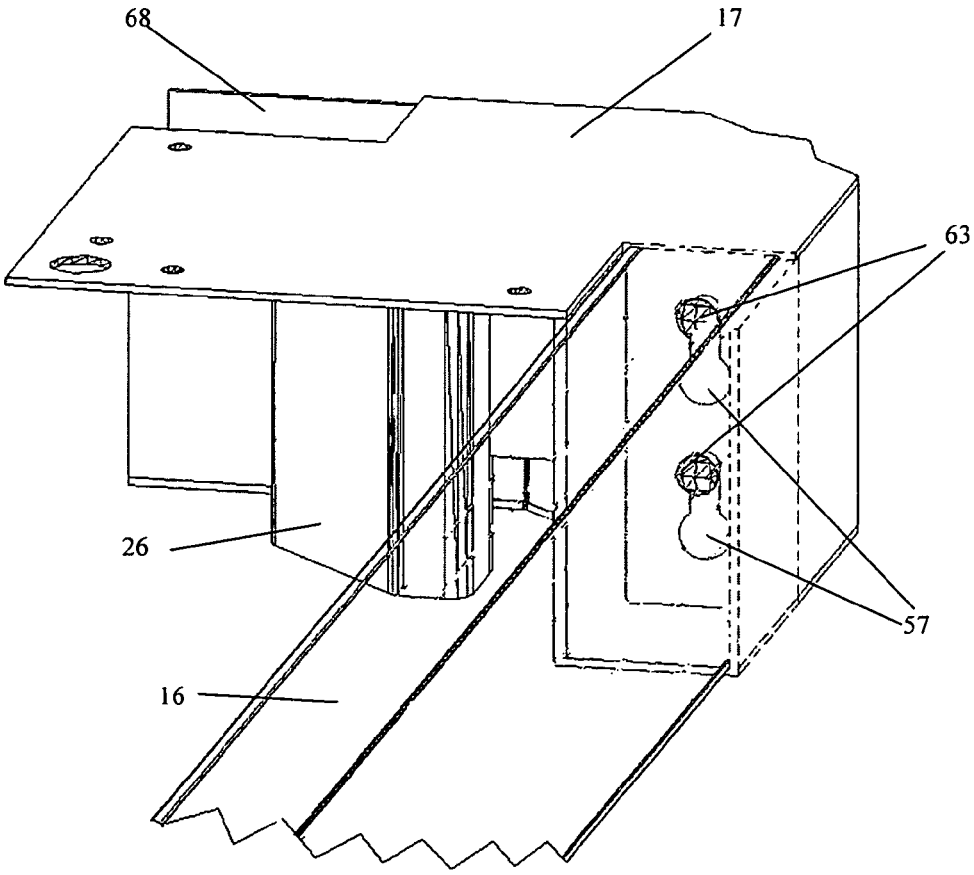
Figure 14A:
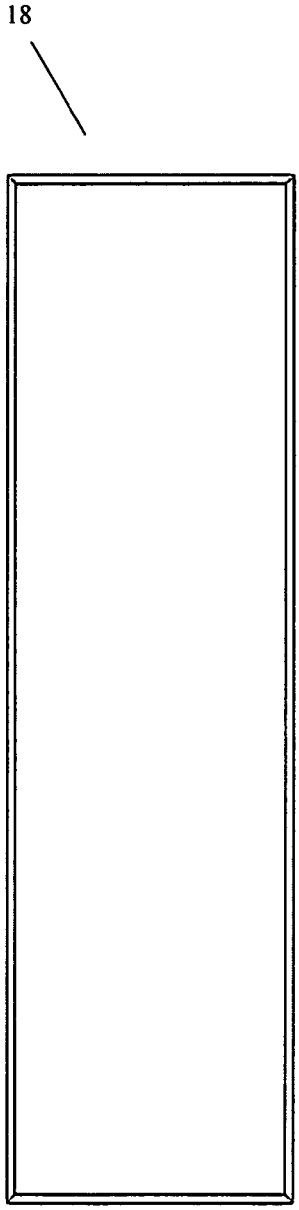
Figure 14B:
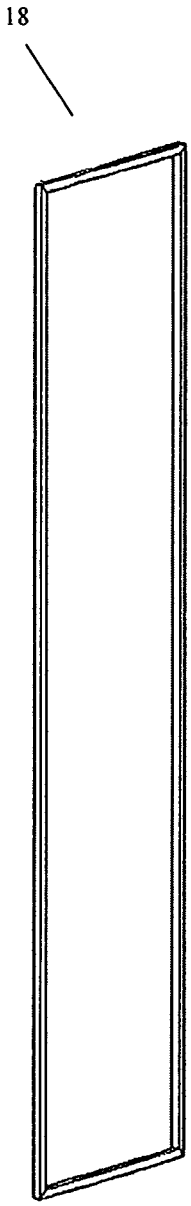
Figure 14C:
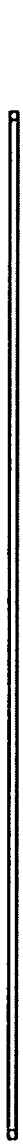
Figure 14D:
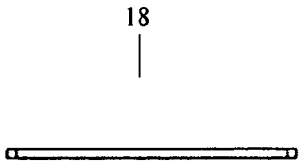
Figure 15:
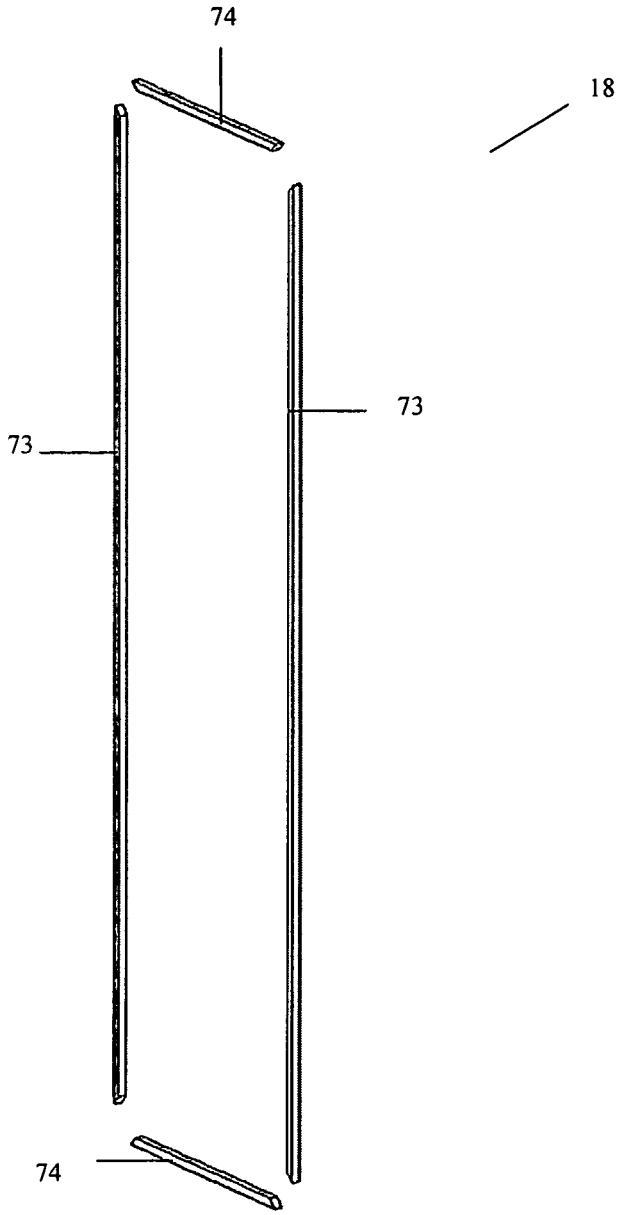
FIG. 15 shows an exploded view of the advertising surface unit illustrated in FIGS. 14A to 14D.

As illustrated in FIGS. 12A to 12E, once the individual components are assembled to form the upper corner unit 17, two inner lateral entrances 68 and 69 are provided, and wherein the corresponding ends 71 and 72 of connecting unit 16 are inserted. Screws 63 are positioned in such manner that holes 57 on connecting unit 16 are easily fastened and secured via a key-hole mechanism as illustrated in detail in FIGS. 13A and 13B. Furthermore, as in the case of support liner 25, support liner 26 is positioned at substantially the center of the upper corner unit 17 and it is surrounded by the lateral covers 61 and the upper platform 58 in such a manner that once the upper section of the lateral is inserted and fastened into said liner, said connection is hidden from the exterior appearance of the display.

Embodiment 10 also comprises advertising support frame 18, which is illustrated in FIGS. 13 and 14 A to 14 D. It has a rectangular structure formed by two longitudinal links or sections 73 and two transversal links or sections 74, which are joined at their ends forming said rectangular structure.

Said advertising support frame 18 provides the support wherein advertisement is placed before being posted on the advertising display embodiment 10.

In operative terms, embodiment 10 may be assembled in different manners for example:

(a) filling out the internal cavity 37 of the base 14 with a given suitable material via the threaded hole 38;

(b) closing said threaded hole 38 with the threaded stopper 42 covered with the threaded liner 41;

(c) engaging each upper corner unit 17 to the lateral supports 12 by inserting upper ends 27 of said lateral supports 12 inside each liner 26, wherein tongues 21 and grooves 22 of the surface of the lateral supports 12 are cooperatively matched with the tongues 23 and grooves 24 on liner 25; and fastening and securing said upper corner units 17 to the connecting unit 16 by means of inserting screws 63 into holes 57 via the key hole mechanism;

(d) engaging each lower corner unit 15 to the lateral supports 12 by inserting lower ends 28 of said lateral supports 12 inside each liner 25, wherein tongues 21 and grooves 22 of the surface of the lateral supports 12 are cooperatively matched with the tongue 23 and grooves 24 on liner 25; and fastening and securing said lower corner units 15 to the corresponding side of base 14 the by means of inserting screws 63 into holes 35 via the key hole mechanism and;

(e) inserting the advertising support frame 18 into the polygonal structure outlined by the connecting unit 16, base 14 and lateral supports 12.

It should be understood that the steps outlined above for the assembling of embodiment 10 are merely illustrative. Any of such steps may be changed or modified, omitted, or rearranged, some of them may be combined, or any additional steps may be included or added, without departing from the scope of the instant invention.

All the above discussed elements, meaning, lateral supports 12, hollow base 14, connecting unit 16, lower corner units 15, upper corner units 17 and advertising support frame 18 may be made of any suitable strong, rigid or flexible material such as iron, plastic, fiberglass, aluminum, combinations thereof. In some embodiments according to the invention, such elements may be coated with thermo material formed with advertisement designs. Each particular element made be molded as a single piece or it may be assembled as disclosed above.

Figure 16:
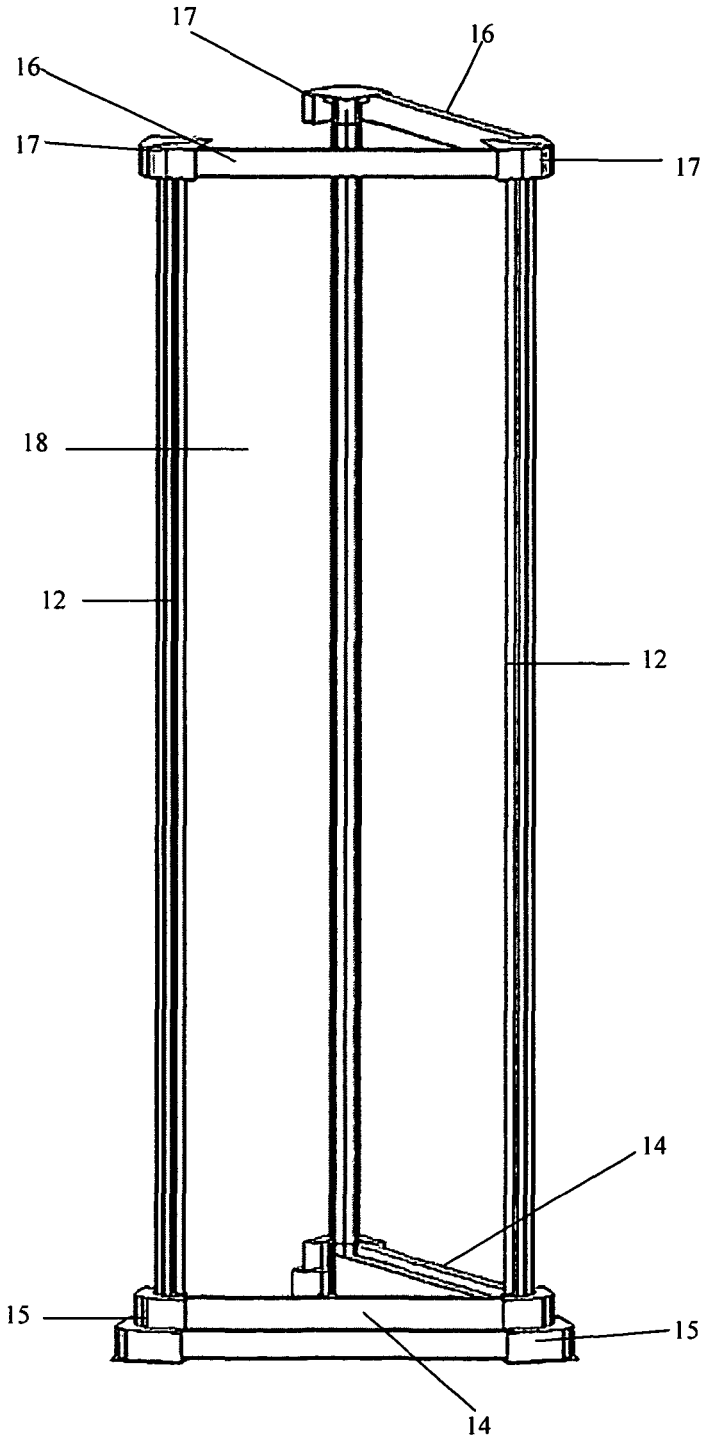
FIG. 16 shows a perspective view of another embodiment of the invention wherein a display tower has a "V" shape structure.
Figure 17:
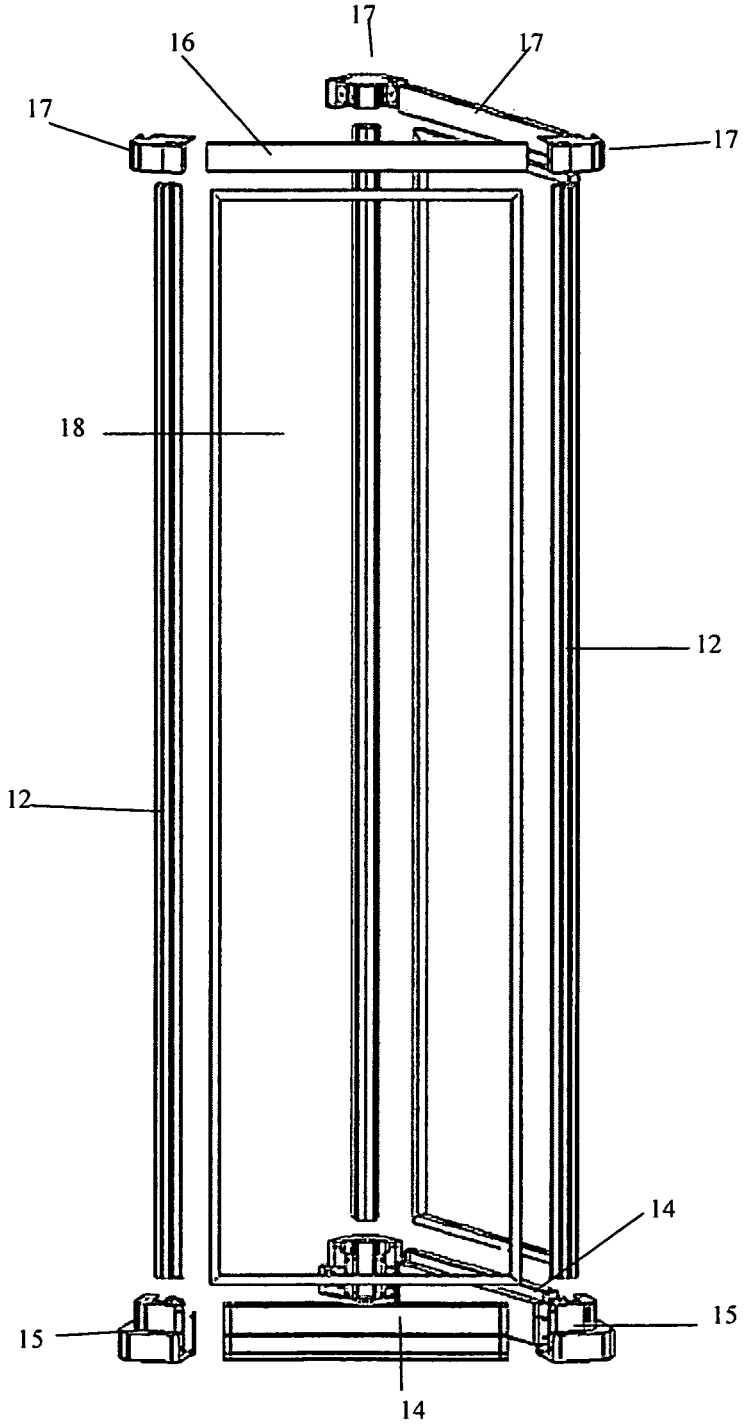
FIG. 17 illustrates an exploded view of the embodiment illustrated in FIG. 16 showing its components thereof.

The instant invention also embraced other embodiments having a tower like structure and more than one advertising face, wherein the above disclosed elements of embodiment 10 are used. For example, as illustrated in FIGS. 16 and 17, embodiment 20 illustrates a "V" shaped tower like advertising display in a tower-like structure and its components thereof. Embodiment 20 comprises two front faces wherein the advertising may be post it. As illustrated in FIGS. 16 and 17, it comprises three lateral supports 12, two hollow bases 14, two connecting units 16, three upper corner units 16; three lower corners units 15 and two advertising support frames 18, thus providing two rectangular advertising faces.

Figure 18:
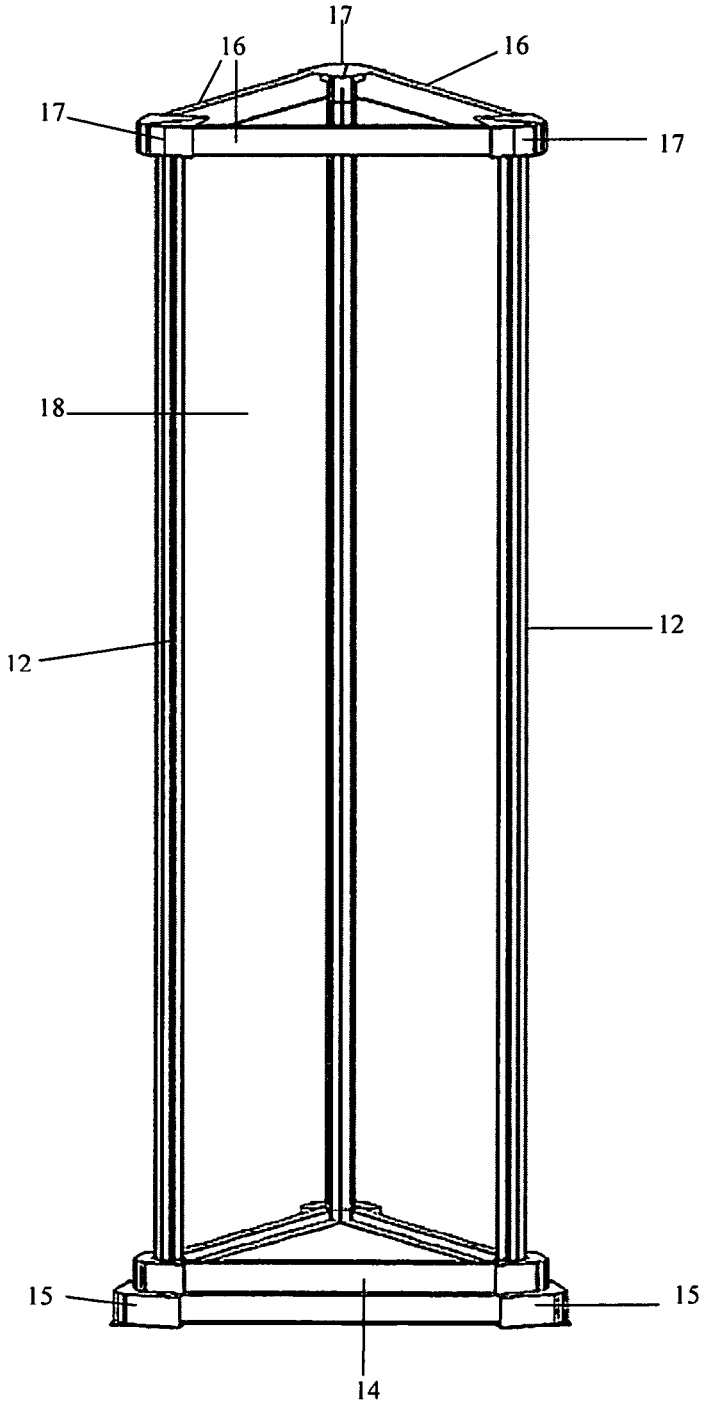
FIG. 18 shows a perspective view of an embodiment of the invention having a triangular-shaped tower structure.
Figure 19:
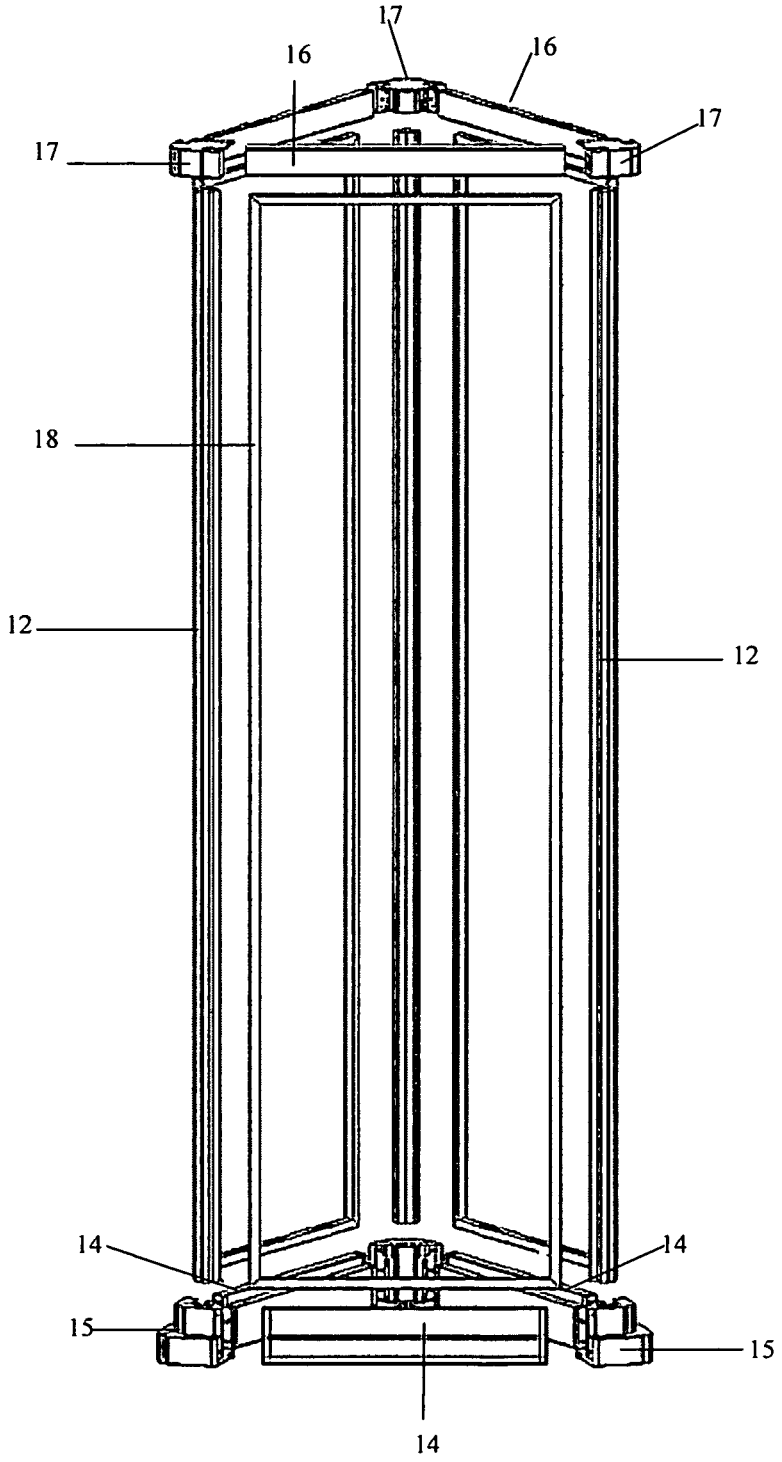
FIG. 19 illustrates a front view of the advertising display shown in FIG. 18 illustrating its components thereof.

Similarly and as illustrated in FIGS. 18 and 19, embodiment 30 according to the instant invention has a triangular shape tower like structure. It comprise three lateral supports 12, three hollow bases 14, three connecting units 16, three upper corner units 16; three lower corners units 15 and three advertising support frames 18, providing three rectangular advertising faces.

Figure 20:
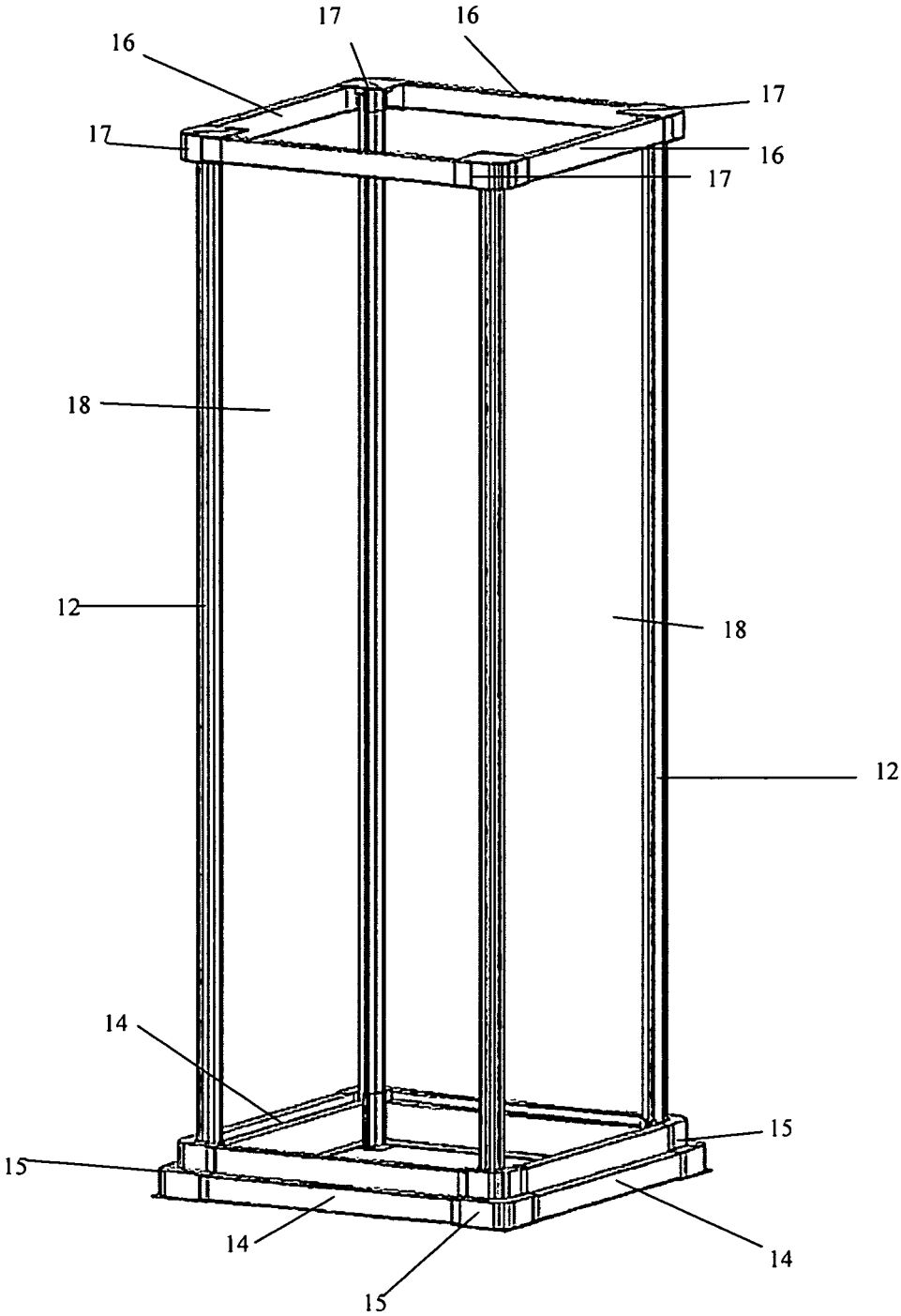
FIG. 20 shows a perspective view of another embodiment of the instant invention, wherein the advertising display as a rectangular or square shape structure.
Figure 21:
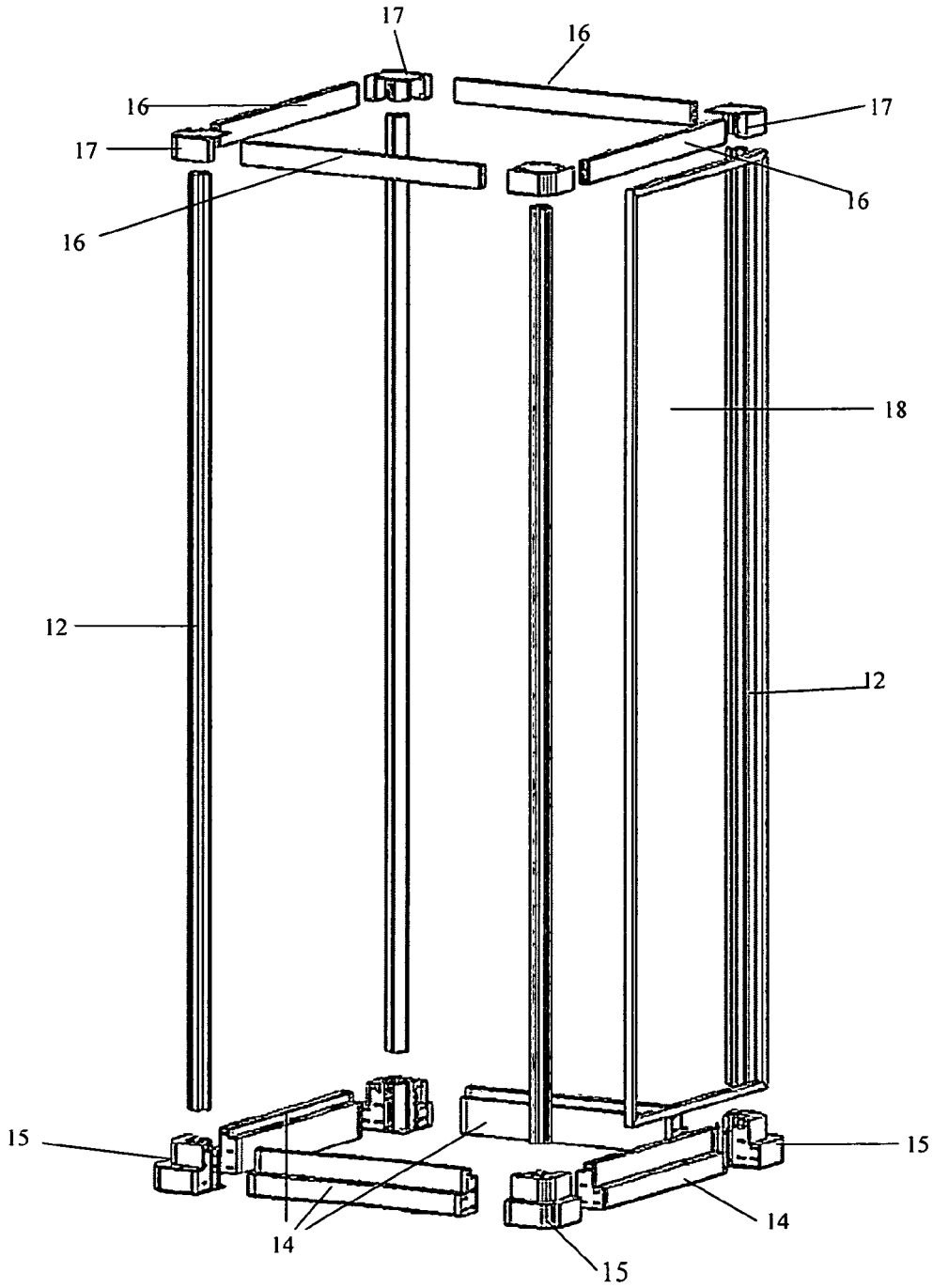
FIG. 21 illustrates a perspective and exploded view of the embodiment illustrated in FIG. 20, showing its components thereof.

FIGS. 20 and 21 illustrate embodiment 40, which as a square tower-like structure. It comprise four lateral supports 12, four hollow bases 14, four connecting units 16, four upper corner units 16; four lower corners units 15 and four advertising support frames 18, thus providing four rectangular advertising faces. In operative terms, embodiments 20, 30 and 40 may be assembled following the already outlined procedure to assemble embodiment 10, since they are made up from the same essential components.

Other embodiments obtained by the combination of the herein disclosed elements for embodiment 10 are within the scope and spirit of the instant invention.

The instant invention also embraced other embodiments, having multiple faces and wherein the faces of the advertising displays are not necessarily rectangular and may have different polygonal shapes. Said embodiments are obtained by arranging lateral supports 12 by joining its upper ends 27 and lower ends 28 in a manner that a given or desired polygonal structural frame is formed. The shapes of the faces or polygonal structure then dictates the number sized of the other elements required in order to complete the entire polygonal advertising display. The herein disclosed frames are presented in a manner of example and other possibilities using the same elements are within the scope of the instant invention. FIGS. 22A to 22D illustrate top views of some frames required in embodiments having different polygonal structures, wherein in each one of said embodiments the advertising frame may have different shapes. Particularly, FIG. 22B illustrates a top view of frame 75, used in the manufacture of a polygonal advertising display having thirteen sides. FIGS. 23A to 23C illustrate different perspective views of frame 75 vertically positioned. Its biggest face, the front section of the profile comprises six of its smaller sides 7*a*, 7*b*, 7*c*, 7*d*, 7*e* and 7*f* creating an uneven diamond-shape surface. The sides pairs 7*a* and 7*b*; 7*c* and 7*d*, 7*e* and 7*f* have the same length, being the joint of sides 7*e* and 7*f* the central joint of this face. The sides of the frame formed by the side pairs 7*g* and 7*h*, 7*i* and 7*j*, 7*k* and 7L are in opposite sides of the frame and have the same size. The back side of said frame, side 7*m*, is joined to the sides 7*k* and 7L to form the rectangular or prism-shaped frame used in the manufacture of the advertising display having thirteen sides or faces. Reinforcement represented by interconnecting bars 76 and 77 provided a crossed reinforcements, which add even more stability to the frame and thus to the obtained advertising display using said structural frame 75.

Figure 22A:
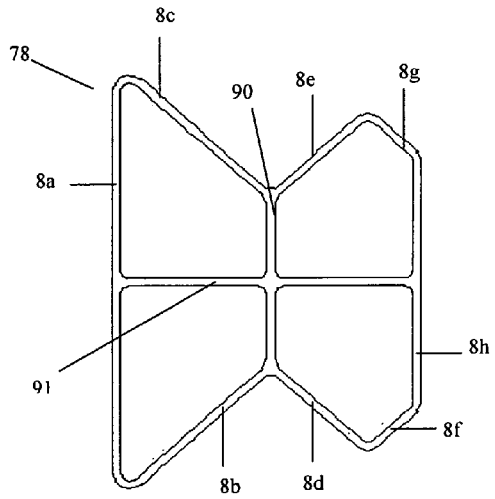
FIGS. 22A to 22D illustrate different top views of polygonal-shaped frames, used in the manufacture of diverse embodiments of the advertising displays according to the invention.
Figure 22B:
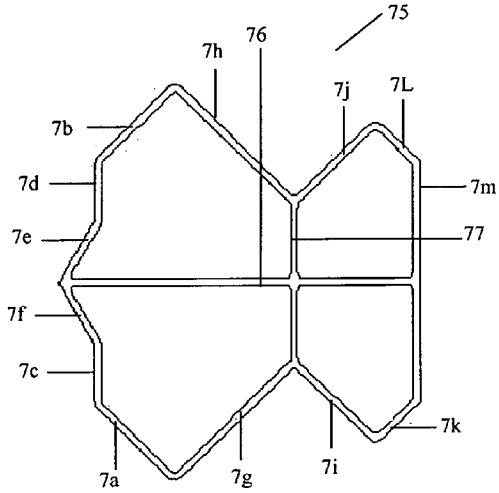
Figure 22C:
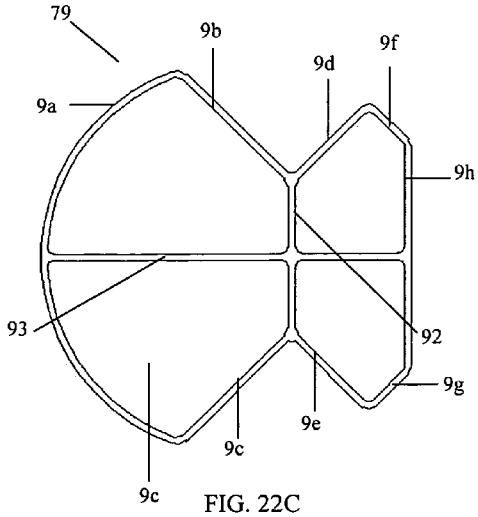
Figure 23A:
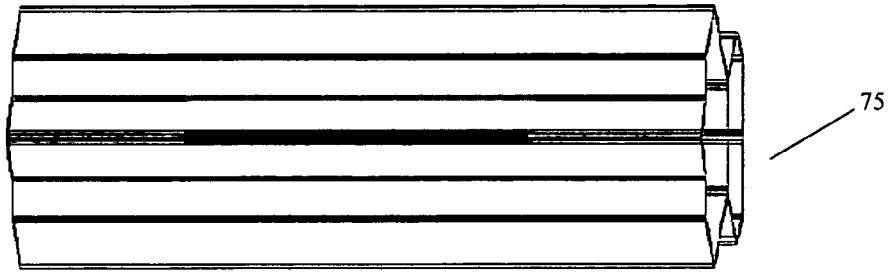
FIGS. 23A to 23D illustrate a polygonal-shaped frame used to manufacture the embodiment according to the invention, wherein the advertising display has eight faces.
Figure 23B:
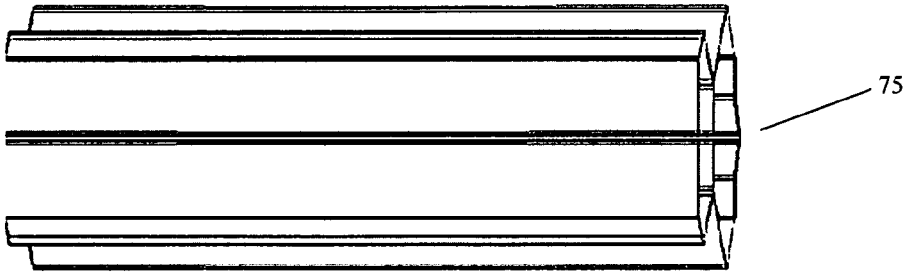
Figure 23C:
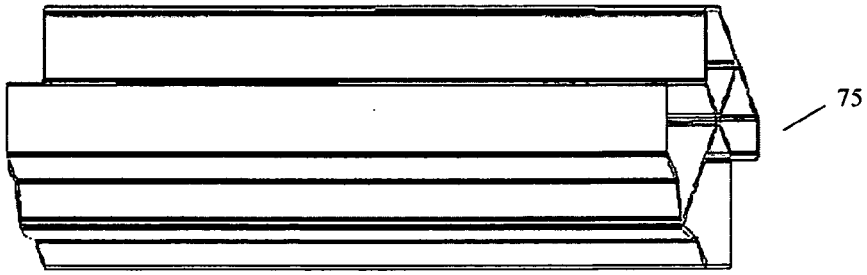
Figure 23D:
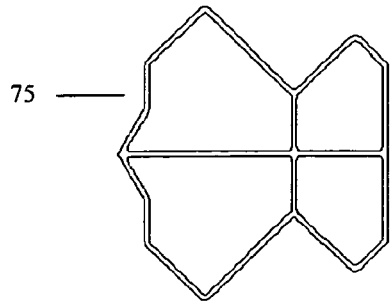
Figure 24A:
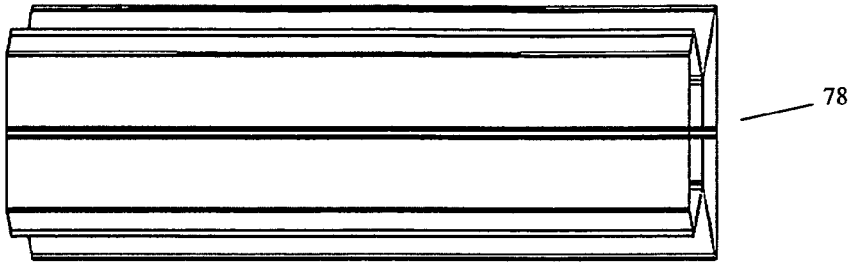
FIGS. 24A to 24D illustrates the polygonal shaped frame used to manufacture an embodiment according to the invention, wherein the advertising displays has eight faces.
Figure 24B:
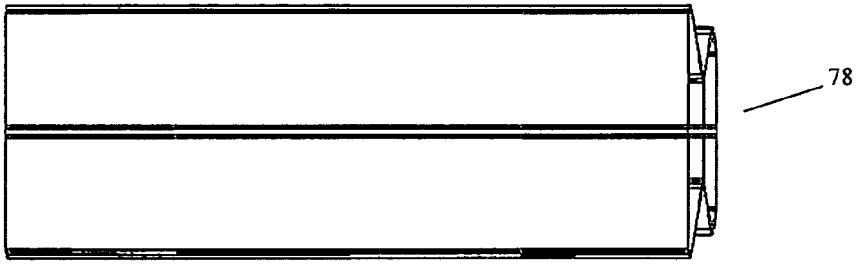
Figure 24C:
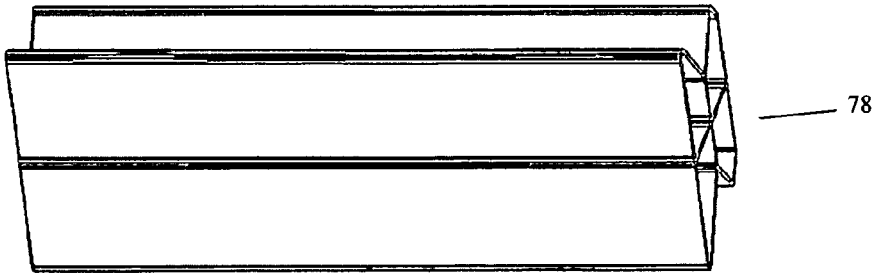
Figure 24D:
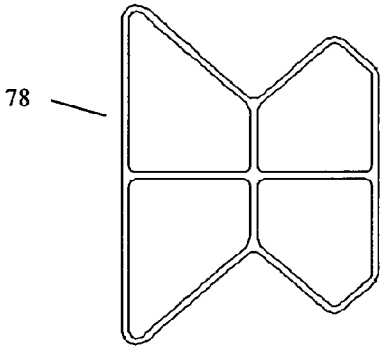

Similarly, FIGS. 22A and 22C illustrate a frames 78 and 79 respectively, used in the manufacture of a polygonal advertising display having eight advertising sides or faces, providing advertising displays that even though have eight faces, have different structural displays shapes. Regarding frame 78, as illustrated in FIGS. 22A and 24A to 24C, its biggest face or the front side, comprises solely the side 8*a*, which is parallel and opposite to the rear side which also comprises only one side, in this case the side 8*h*. The sides of this polygonal frame 78 are made up of opposite sides 8*b* and 8*c* of equal length, and opposite sides 8*d* and 8*e* of equal length, and opposite sides 8*f* and 8*g* of equal length, joining the latter on the side 8*h*. Sides 8*b* and 8*c* are joined on the side 8*a*, forming an eight-sided polygonal frame 78. The eight-sided polygonal frame 78 has crossed reinforcements 90 and 91 extending through the entire length of its structural frame. These reinforcements link the central part of side 8*h* with the central union of main face on side 8*a* on its larger portion; on the smaller portion reinforcements join the convergence points of sides 8*b* and 8*d*, and sides 8*c* and 8*e*, forming a union or crossed reinforcement throughout the eight-sided polygonal frame 78, giving it greater strength and consistency. FIGS. 24A to 24C illustrates views of frame 78 from different views in a vertical position.

Figure 25A:
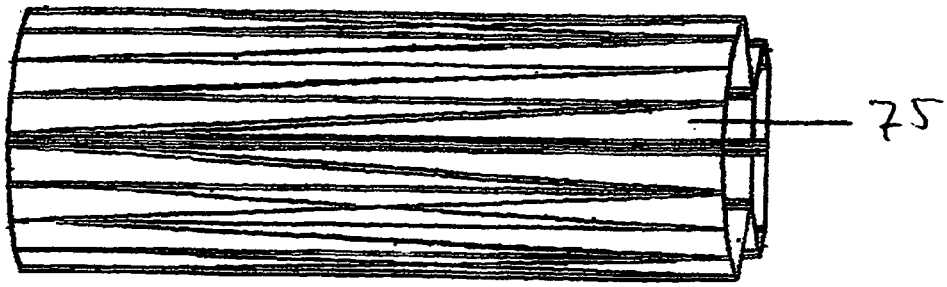
FIGS. 25A to 25D illustrate a polygonal shaped frame used to manufacture an embodiment according to the invention, wherein the advertising display has nine faces.
Figure 25B:
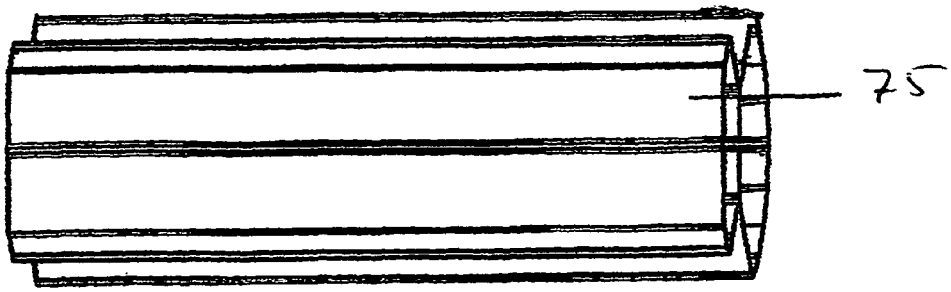
Figure 25C:
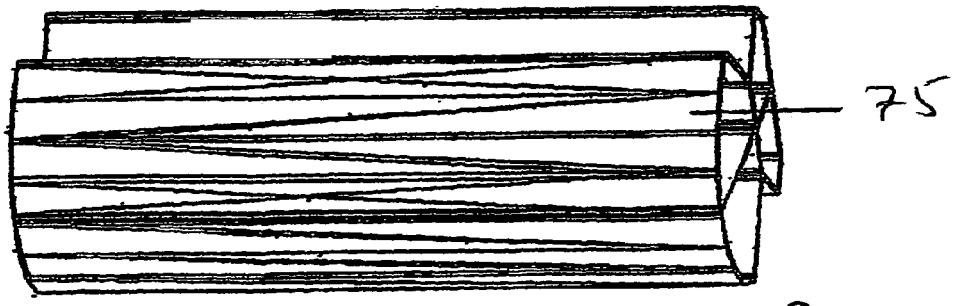
Figure 25D:
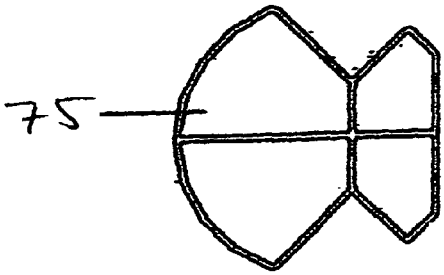

On the other hand, FIG. 22C illustrates a top view of another polygonal structural frame 79 having eight faces, wherein the larger side 9*a* has a curved or arch-shape. The rear side is made up of the face 9*h* and the lateral sides comprise faces 9*b* and 9*c* which are equal regarding size and parallel opposite sides; faces 9*d* and 9*e* are equal regarding size and positioned in a parallel manner. Similarly, sides or faces 9*f* and 9*g* are equal in size and parallel to each other, thus forming all these sides an eight-sided polygonal frame 79 where the longer side is a curved or arched side. The eight-sided polygonal frame 79 has crossed reinforcements 92 and 93 extending through the entire length of its frame. These reinforcements link the central part of side (9*h*) with the central union of main face on side 9*a* on its larger portion. Said reinforcements also join the convergence points of sides 9*c* and 9*e*, and sides 9*b* and 9*d*, forming a union or crossed reinforcement throughout the eight-sided polygonal frame 79, giving it greater strength and consistency. FIGS. 25A to 25C illustrate different views of the frame 79 from different perspectives at a vertical position.

Figure 22D:
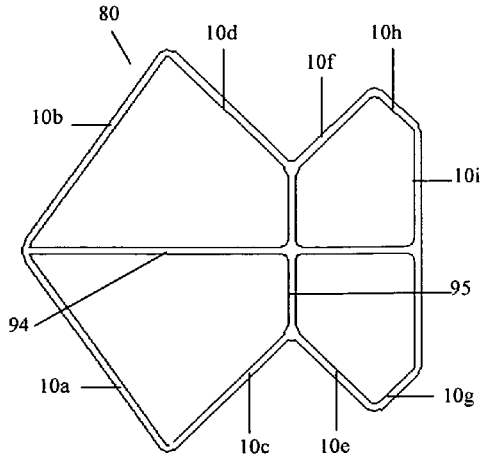
Figure 26A:
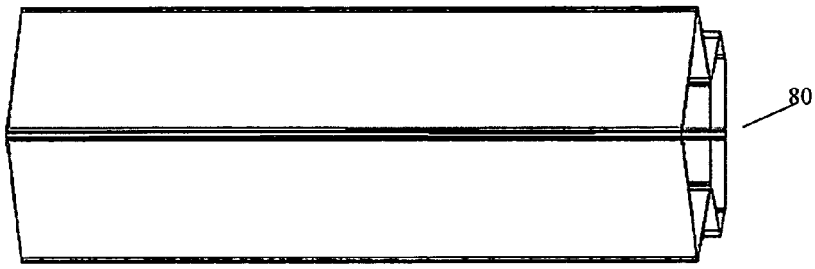
FIGS. 26A to 26D illustrate a polygonal shaped frame used to manufacture an embodiment according to the invention, wherein the advertising display has nine faces.
Figure 26B:
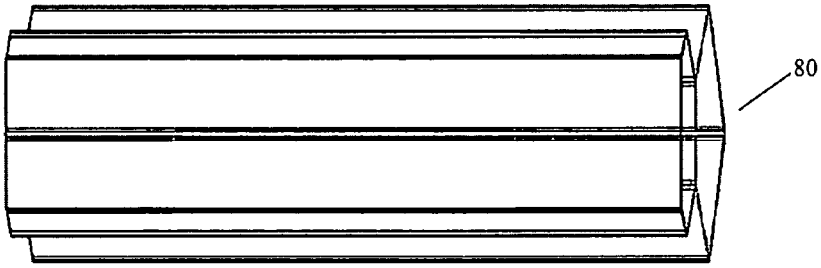
Figure 26C:
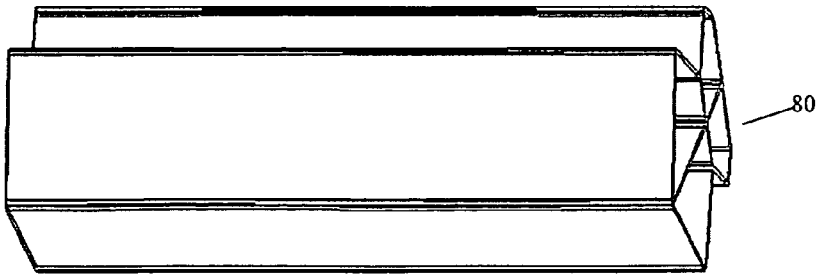
Figure 26D:
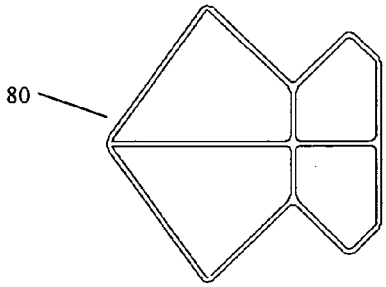

In a similar manner, FIG. 22D illustrates a top view of the structural frame 80, which has nine sides or faces. Its front face is formed by the convergence of the sides 80*a* and 80*b*, while its rear face is formed by the sides 80*i*, 80*h* and 80*g*. The nine-sided polygonal structural frame 80 has crossed reinforcements 94 and 95 extending through the entire length of the frame 80. These reinforcements link the central part of side 80*i* with central union of main face formed by the sides 80*a* and 80*b* on its larger portion; on the smaller portion, reinforcements join the convergence points of sides 80*c* and 80*e* and sides 80*d* and 80*f*, forming a union or crossed reinforcement throughout the nine-sided polygonal frame 80, giving it greater strength and consistency. FIGS. 26A to 26C shows different views of frame 80 from different perspectives at vertical positions.

It will be understood that the foregoing is only illustrative of the principles of the invention, and that various modifications may be made by those skilled in the art without departing from the scope and spirit of the invention. Indeed, those skilled in the art will appreciate that the invention may be practices by others than the described embodiments, which are presented for purpose of illustrating rather than of limitation, and the invention is limited only by the claims that follow.

The invention claimed is:

1. Portable and self-standing polygonal advertising displays, useful in the promotion of goods and services, said advertising displays comprising:

at least one advertising support frame having a predetermined polygonal structure comprising lateral sides, upper ends and lower ends, wherein the number of lateral sides, lower and upper ends depend on the predetermined polygonal structure of said advertising support unit;

at least one base, said base comprising:

a main hollow body comprising a first end and a second end;

a seal unit, a closing unit and a safety angled holder at each one of said ends, thus creating an internal cavity;

multiple openings on each closing unit at each one of said ends;

at least a threaded hole located at said main body, at least a threaded liner and at least a threaded stopper;

at least two lateral supports, said lateral supports being positioned parallel one to another and each of them having an upper end and a lower end, each end having tongues and grooves at its external surface;

at least one connecting unit comprising an elongated body having a first end and a second end; wherein each of said connecting unit ends have at least two openings;

at least two upper corner units, each upper corner unit comprising:

an internal liner having an inner cavity and multiple tongues and grooves cooperatively matching with said tongues and grooves at the upper end of the lateral supports;

two lateral sides;

at least two male fastening elements at each one of said lateral side, said male fastening elements cooperatively matching with the openings at the ends of said connecting unit;

at least two lower corner units; each lower corner unit comprising:

an internal liner having tongues and grooves that cooperatively match with said tongue and grooves at the lower end of the lateral supports;

at least two lateral sides;

multiple male fastening elements located at each one of said lateral sides, said male fastening elements cooperatively matching with the openings at the ends of said hollow base;

wherein the display is assembled by filling out the internal cavity of the base with a given material; engaging the tongues and grooves at internal liner at the upper corner units to the tongue and grooves at the upper ends of the lateral supports; and fastening the connecting unit to the corresponding sides of the upper corner units by cooperatively matching the openings at the connecting unit with the male fastening elements at the upper corner units; engaging the tongues and grooves at internal liner at the lower corner units to the tongue and grooves at the lower ends of the lateral supports; fastening hollow base with the lower corner units by matching the openings at each end of the hollow base with the corresponding male fastening elements at the lower corner units, thus creating a frame with at least one internal space and inserting in each said internal space said advertising support unit.

2. The advertising display unit as recited in claim 1, having a single rectangular advertising support unit.

3. The advertising display as recited in claim 1, having two rectangular advertising support units.

4. The advertising display as recited in claim 1, having three rectangular advertising support units.

5. The advertising displays as recited in claim 1, having four advertising support units.

6. The advertising displays as recited in claim 1, wherein the advertising display has multiple lateral support units arranged in different polygonal structures.

7. The advertising display as recited in claim 6, further comprising at least two inner crossed reinforcements joining said multiple lateral support units.

8. The advertising displays as recited in claim 7, wherein the advertising display has a polygonal structure of 8 sides or faces.

9. The advertising displays as recited in claim 7, wherein the advertising display has a polygonal structure of 9 sides or faces.

10. The advertising displays as recited in claim 7, wherein the advertising display has a polygonal structure of 13 sides or faces.

11. The advertising display as recited in claim 1, wherein the given material used to fill out the base is selected from a solid material.

12. The advertising display as recited in claim 11, wherein the solid material used to fill out the base is sand.

13. The advertising display as recited in claim 1, wherein the given material used to fill out the base is selected from a liquid material.

14. The advertising display as recited in claim 13, wherein the liquid material used to fill out the base is water.

* * * * *